US009202417B2

(12) United States Patent
Yamada

(10) Patent No.: US 9,202,417 B2
(45) Date of Patent: Dec. 1, 2015

(54) DRIVING METHOD OF ELECTROPHORETIC DISPLAY DEVICE, AND CONTROLLER

(75) Inventor: Yusuke Yamada, Shiojiri (JP)

(73) Assignee: Seiko Epson Corporation (JP)

( * ) Notice: Subject to any disclaimer, the term of this patent is extended or adjusted under 35 U.S.C. 154(b) by 673 days.

(21) Appl. No.: 13/028,530

(22) Filed: Feb. 16, 2011

(65) Prior Publication Data

US 2011/0216101 A1 Sep. 8, 2011

(30) Foreign Application Priority Data

Mar. 8, 2010 (JP) ..... 2010-050661

(51) Int. Cl.
*G09G 3/00* (2006.01)
*G09G 3/34* (2006.01)
*G09G 5/10* (2006.01)

(52) U.S. Cl.
CPC ... *G09G 3/34* (2013.01); *G09G 5/10* (2013.01)

(58) Field of Classification Search
USPC ..... 359/296
See application file for complete search history.

(56) References Cited

U.S. PATENT DOCUMENTS

2004/0184136 A1* 9/2004 Goden ..... 359/296
2005/0270267 A1 12/2005 Johnson
2006/0071902 A1 4/2006 Zhou et al.
2006/0139305 A1 6/2006 Zhou et al.
2006/0290652 A1 12/2006 Zhou et al.
2007/0057905 A1 3/2007 Johnson et al.
2007/0057907 A1 3/2007 Ishii et al.
2007/0091418 A1 4/2007 Danner et al.
2007/0120812 A1 5/2007 Nagayama
2007/0132687 A1* 6/2007 Johnson ..... 345/89
2011/0216099 A1 9/2011 Yamada

FOREIGN PATENT DOCUMENTS

CN 1742312 A 3/2006
CN 102194414 A 9/2011
JP 2007-079170 3/2007

* cited by examiner

*Primary Examiner* — Amare Mengistu
*Assistant Examiner* — Joseph G Rodriguez
(74) *Attorney, Agent, or Firm* — Harness, Dickey & Pierce, P.L.C.

(57) ABSTRACT

A driving method of an electrophoretic display device, which has a plurality of pixels where an electrophoretic layer is interposed between a first electrode and a second electrode, including supplying a first voltage pulse with one polarity of a first polarity or a second polarity to a first pixel in a third display state between a first display state and a second display state, supplying a second voltage pulse with the other polarity of the first polarity or the second polarity to the first pixel, supplying a third voltage pulse, which has the same polarity as the polarity of the first voltage pulse and has a duration different from a duration of the first voltage pulse, to a second pixel which is in the third display state, and supplying the second voltage pulse to the second pixel.

18 Claims, 10 Drawing Sheets

FIG. 7A RESET TO WHITE DISPLAY

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 11 | 11 | 11 | 11 | 11 | 11 | 11 | 11 | 11 | 11 | 11 |

FIG. 7B BLACK DISPLAY OF BLACK-SIDE GRADATION

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 11 | 11 | 11 | 11 | 11 | 0 | 0 | 0 | 0 | 0 | 0 |

FIG. 7C DISPLAY INITIAL GRADATION

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 11 | 9 | 9 | 9 | 9 | 2 | 2 | 2 | 2 | 0 | 0 |

FIG. 7D EXCESSIVE WHITE PREPARATION DRIVING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 15 | 13 | 9 | 9 | 9 | 9 | 2 | 2 | 2 | 2 | 0 | 0 |

FIG. 7E EXCESSIVE BLACK PREPARATION DRIVING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 15 | 13 | 9 | 9 | 9 | 9 | 2 | 2 | 2 | 2 | −2 | −4 |

FIG. 8A FIRST BLACK WRITING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 10 | 9 | 9 | 9 | 9 | 2 | 2 | 2 | 2 | -2 | -4 |

FIG. 8B FIRST WHITE WRITING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 10 | 9 | 9 | 9 | 9 | 2 | 2 | 2 | 2 | 1 | 0 |

FIG. 8C SEQUENTIAL BLACK PREPARATION DRIVING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 10 | 6 | 4 | 6 | 4 | 2 | 2 | 2 | 2 | 1 | 0 |

FIG. 8D SEQUENTIAL WHITE PREPARATION DRIVING

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 10 | 6 | 4 | 6 | 4 | 7 | 5 | 7 | 5 | 1 | 0 |

FIG. 9A SECOND WHITE WRITING
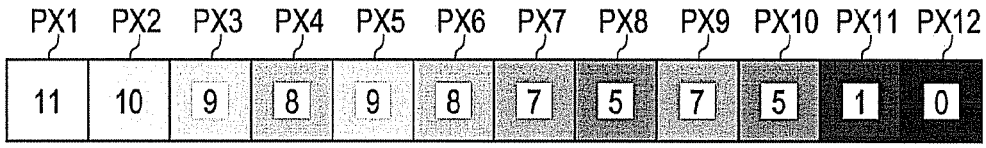
FIG. 9B SECOND BLACK WRITING
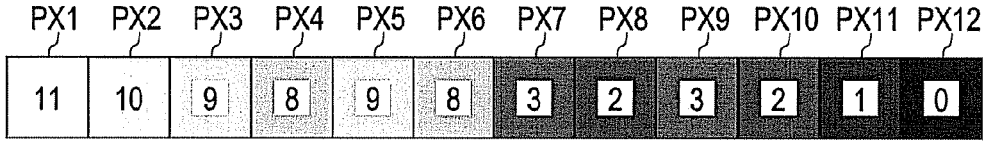
FIG. 9C INTERMEDIATE PORTION BLACK WRITING
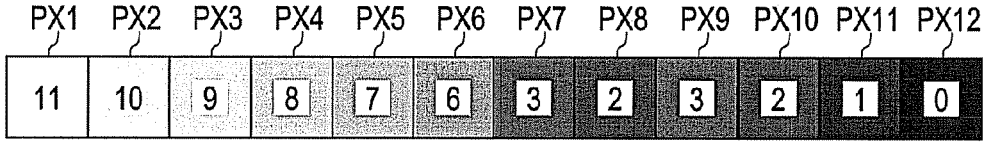
FIG. 9D INTERMEDIATE PORTION WHITE WRITING
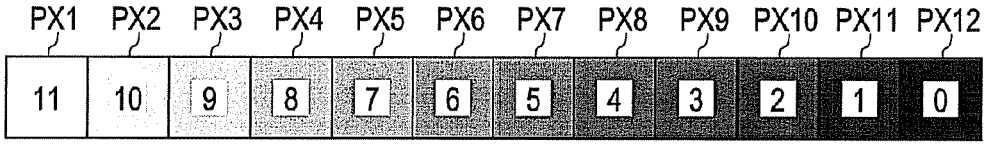

ST20'

| PX1 | PX2 | PX3 | PX4 | PX5 | PX6 | PX7 | PX8 | PX9 | PX10 | PX11 | PX12 |
|---|---|---|---|---|---|---|---|---|---|---|---|
| 11 | 11 | 0 | 0 | 0 | 0 | 11 | 11 | 11 | 11 | 0 | 0 |

DRIVING METHOD OF ELECTROPHORETIC DISPLAY DEVICE, AND CONTROLLER

BACKGROUND

1. Technical Field

The present invention relates to a driving method of an electrophoretic display device.

2. Related Art

In this type of electrophoretic display device, in regard to each of a plurality of pixels, an image is displayed by moving the electrophoretic particles through application of a driving voltage to, for example, an electrophoretic layer including white and black electrophoretic particles interposed between a pixel electrode and a common electrode. Additionally, it is possible to perform multitone display where a halftone (for example, gray) is displayed by changing the period of time when a driving voltage is applied to the electrophoretic layer for each pixel. In order to perform multitone display with high precision, it is necessary to control the application time of a driving voltage with high precision.

For example, in JP-A-2007-79170, a technology is disclosed for preventing an uneven display of color in a case of switching between display colors in an electrophoretic display device, by changing the application time of a driving voltage in accordance with the continuous display time of a display color displayed before switching.

In this type of electrophoretic display device, there is a technical problem in that it is difficult to perform multitone display with high precision which requires controlling of the application time of the driving voltage with high precision. In particular, it is difficult to control the application time of the driving voltage so that the halftone to be displayed is accurately displayed in each pixel since the motion of the electrophoretic particles when applying the driving voltage varies with the environment, such as temperature and humidity. As a result, an accurate display is difficult when the number of gradation levels is increased.

SUMMARY

An advantage of some aspects of the invention is that a driving method of an electrophoretic display device is provided which is capable of performing multitone display with high precision.

A driving method of an electrophoretic display device of the invention, which has a plurality of pixels where an electrophoretic layer is interposed between a first electrode and a second electrode, and when in a case when the potential of the first electrode is higher than the potential of the second electrode, a first polarity is set, and in a case when the potential of the first electrode is lower than the potential of the second electrode, a second polarity is set, as a display state of the pixel, a first display state is selected by supplying a voltage with the first polarity to the pixel and a second display state is selected by supplying a voltage with the second polarity to the pixel, and a halftone state between the first display state and the second display state is selected according to a duration of the voltage pulse supplied to the pixel; including supplying a first voltage pulse with one polarity of the first polarity or the second polarity to a first pixel in a third display state between the first display state and the second display state out of the plurality of pixels, supplying a second voltage pulse with the other polarity of the first polarity or the second polarity to the first pixel, supplying a third voltage pulse, which has the same polarity as the polarity of the first voltage pulse and has a duration different from a duration of the first voltage pulse, to a second pixel which is in the third display state out of the plurality of pixels, and supplying the second voltage pulse to the second pixel.

According to the driving method of the invention, for example, first, the first and the second pixels are set to the third display state (for example, gray, that is, a halftone state) between the first display state (for example, black) and the second display state (for example, white) by supplying the same voltage pulse to the first and the second pixels. Next, the first voltage pulse and the second voltage pulse with a polarity different from that of the first voltage pulse are supplied in order to the first pixel in the third display state. According to this, the first pixel is set in a state of halftone to be displayed. That is, a first halftone, which is, for example, a gray with a first density, is displayed in the first pixel. In addition, the second voltage pulse typically has a duration different from a duration of the first voltage pulse, but it may have the same duration. Furthermore, according to the driving method of the invention, the second pixel which is in the third display state similar to the first pixel is supplied with the third voltage pulse, which has the same polarity as the first voltage pulse and has a duration different from a duration of the first voltage pulse, and is further supplied with the second voltage pulse similar to the first pixel. According to this, a second halftone, which is, for example, a gray with a second density which is different from the first density, is displayed in the second pixel.

In this manner, in the invention, when displaying halftones which are different from each other in the first and the second pixels, the first voltage pulse is supplied to the first pixel in the third display state, the third voltage pulse (that is, the voltage pulse which has the same polarity as that of the first voltage pulse and has a duration different from that of the first voltage pulse) is supplied to the second pixel in the third display state, and the second voltage pulse (that is, the voltage pulse with a polarity different from that of the first and the third voltage pulses) is supplied to the first and the second pixels.

Here, for example, in a case where the first and the third voltage pulses have the second polarity, the first pixel becomes the first halftone state which is different from that of the third display state due to the first voltage pulse being supplied to the first pixel in the third display state, and the second pixel becomes the second halftone state which is different from that of the third display state and the first halftone state due to the third voltage pulse being supplied to the second pixel in the third display state.

In the invention, in particular, the first and the second pixels, which have become display states (for example, halftone states) different from each other due to being supplied with the first and the third voltage pulses in this manner, are supplied with the second voltage pulse with a polarity different from that of the first and the third voltage pulses. According to this, it is possible to make the display states (for example, halftone states) of the first and the second pixels closer to each other. As such, it is possible to finely control gradations of the first and the second pixels. That is, for example, it is possible to increase the number of gradations which can be displayed in the first and the second pixels compared to a case where gradations displayed in the first and the second pixels are controlled by supplying only the first voltage pulse to the first pixel in the third display state and supplying only the third voltage pulse to the second pixel in the third display state. Accordingly, it is possible to perform multitone display with high precision.

In addition, it was ascertained in experiments by the inventors and the like that the display states of the first and the second pixels are made closer to each other by supplying the second voltage pulse with a polarity different from that of the first and the third voltage pulses to the first and the second pixels which have become display states different from each other due to being supplied with the first and the third voltage pulses as in the invention.

Furthermore, in the invention, in particular, when the first and the second pixels display halftones different from each other, as described above, for example, first, the first and the second pixels are set to the third display state (for example, gray, that is, a halftone state) between the first display state (for example, black) and the second display state (for example, white) by supplying the same voltage pulse to the first and the second pixels. That is, when the first and the second pixels are displaying halftones different from each other, the first and the second pixels display the third display state which is closer to the halftone to be displayed by each of the first and the second pixels than, for example, the first display state or the second display state. As such, when displaying an image including halftone in the plurality of pixels, it is possible to quickly display the image to be displayed in a gradation rougher than the gradation to be displayed. In other words, when displaying an image including halftone, it is possible to display an image close to the image to be displayed at an initial stage. Accordingly, it is possible for a user to promptly visually recognize the content of the image to be displayed.

As described above, according to the driving method of the electrophoretic display device of the invention, it is possible to perform multitone display with high precision. In addition, when displaying an image including halftone, it is possible to display an image close to the image to be displayed at an initial stage.

In an aspect of the driving method of the electrophoretic display device of the invention, there is further included supplying a fourth voltage pulse with one polarity of the first and the second polarity to a third pixel in a fourth display state between the second display state and the third display state out of the plurality of pixels, supplying a fifth voltage pulse with the other polarity of the first polarity or the second polarity to the third pixel, supplying a sixth voltage pulse, which has the same polarity as the polarity of the fourth voltage pulse and has a duration different from a duration of the fourth voltage pulse, to a fourth pixel which is in the fourth display state out of the plurality of pixels, and supplying the fifth voltage pulse to the fourth pixel.

According to the aspect, when the third and the fourth pixels display halftones different from each other, the fourth voltage pulse is supplied to the third pixel in the fourth display state, the sixth voltage pulse (that is, the voltage pulse which has the same polarity as the fourth voltage pulse and has a duration different from that of the fourth voltage pulse) is supplied to the fourth pixel in the fourth display state, and the fifth voltage pulse (that is, the voltage pulse with a polarity different from the fourth and the sixth voltage pulses) is supplied to the third and the fourth pixels.

Here, for example, in a case where the fourth and the sixth voltage pulses have the first polarity, the third pixel becomes a third halftone state which is different from that of the fourth display state due to the fourth voltage pulse being supplied to the third pixel in the fourth display state and the fourth pixel becomes a fourth halftone state which is different from that of the fourth display state and the third halftone state due to the sixth voltage pulse being supplied to the fourth pixel in the fourth display state.

In the aspect, in particular, the third and the fourth pixels, which have become display states (for example, halftone states) different from each other due to being supplied with the fourth and the sixth voltage pulses in this manner, are supplied with the fifth voltage pulse with a polarity different from that of the fourth and the sixth voltage pulses. According to this, it is possible to make the display states (for example, halftone states) of the third and the fourth pixels closer to each other. As such, it is possible to finely control the gradations of the third and the fourth pixels. In other words, it is possible to increase the number of gradations of gradations which can be displayed in the third and the fourth pixels. Accordingly, it is possible to perform multitone display with high precision.

In another aspect of the driving method of the electrophoretic display device of the invention, the display state of the first pixel after the second voltage pulse is supplied to the first pixel is a display state between the display state of the third pixel after the fifth voltage pulse is supplied to the third pixel and the first display state.

According to the aspect, after the second voltage pulse is supplied to the first pixel and the fifth voltage pulse is supplied to the third pixel, it is possible to reliably display an image close to the image to be displayed. Accordingly, it is possible for a user to promptly visually recognize the content of the image to be displayed.

In another aspect of the driving method of the electrophoretic display device of the invention, there is further included supplying a seventh voltage pulse with a polarity different from that of the second voltage pulse to the first and the second pixels.

According to the aspect, for example, after the second voltage pulse is supplied to the first and the second pixels, the seventh voltage pulse with a polarity different from that of the second voltage pulse is supplied to the first and the second pixels. According to this, it is possible to make the display states (for example, halftone states) of the first and the second pixels even closer to each other. Accordingly, it is possible to further finely control the gradations of the first and the second pixels.

In another aspect of the driving method of the electrophoretic display device of the invention, there is further included supplying an eighth voltage pulse with a polarity different from that of the fifth voltage pulse to the third and the fourth pixels.

According to the aspect, for example, after the fifth voltage pulse is supplied to the third and the fourth pixels, the eighth voltage pulse with a polarity different from that of the fifth voltage pulse is supplied to the third and the fourth pixels. According to this, it is possible to make the display states (for example, halftone states) of the third and the fourth pixels even closer to each other. Accordingly, it is possible to further finely control the gradations of the third and the fourth pixel.

The actions and other advantages of the invention will be made clear from the embodiment for executing the invention described next.

BRIEF DESCRIPTION OF THE DRAWINGS

The invention will be described with reference to the accompanying drawings, wherein like numbers reference like elements.

FIGS. 7A to 7E are schematic diagrams (1) illustrating display states of pixels PX1 to PX12 when each step shown in FIG. 6 is performed.

FIGS. 8A to 8D are schematic diagrams (2) illustrating display states of pixels PX1 to PX12 when each step shown in FIG. 6 is performed.

FIGS. 9A to 9D are schematic diagrams (3) illustrating display states of pixels PX1 to PX12 when each step shown in FIG. 6 is performed.

DESCRIPTION OF EXEMPLARY EMBODIMENTS

Below, the embodiments of the invention are described while referring to the diagrams.

First Embodiment

A driving method of an electrophoretic display device according to the first embodiment will be described with reference to FIGS. 1 to 11.

First, an overall configuration of the electrophoretic display device according to the embodiment will be described with reference to FIGS. 1 and 2.

Figure 1:
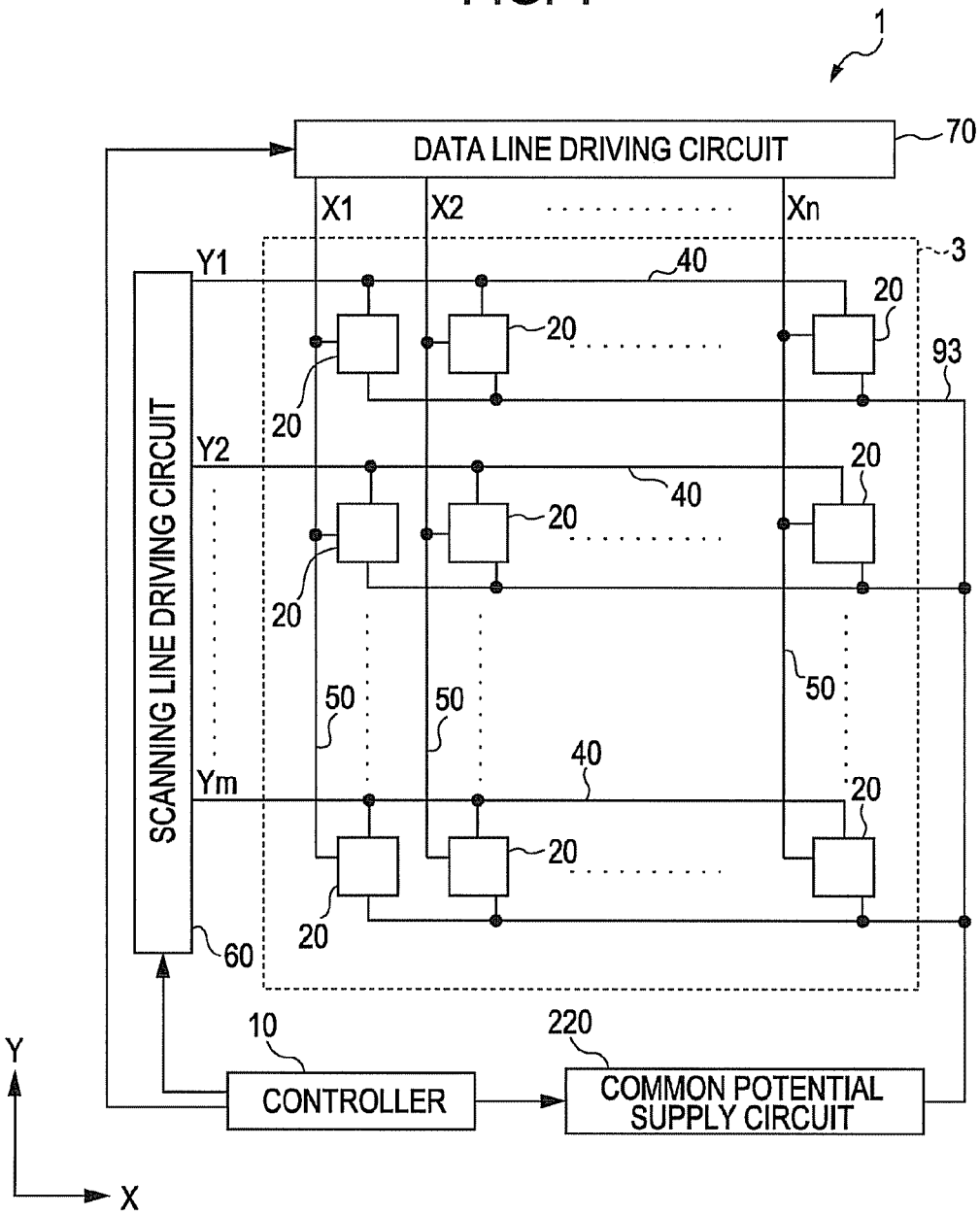
FIG. 1 is a block diagram illustrating an overall configuration of an electrophoretic display device according to a first embodiment.

FIG. 1 is a block diagram illustrating the overall configuration of the electrophoretic display device according to the embodiment.

In FIG. 1, an electrophoretic display device 1 according to the embodiment includes a display unit 3, a controller 10, a scanning line driving circuit 60, a data line driving circuit 70 and a common potential supply circuit 220.

In the display unit 3, m rows and n columns of pixels 20 are arranged in a matrix (two dimensional planar) shape. Also, in the display unit 3, m scanning lines 40 (that is, scanning lines Y1, Y2, . . . , Ym) and n data lines 50 (that is, data lines X1, X2, . . . , Xn) are provided to intersect with each other. Specifically, the m scanning lines 40 extend in a row direction (that is, an X direction) and the n data lines 50 extend in a column direction (that is, a Y direction). The pixels 20 are arranged to correspond to the intersections of the m scanning lines 40 and the n data lines 50.

The controller 10 controls the operations of the scanning line driving circuit 60, the data line driving circuit 70, and the common potential supply circuit 220. The controller 10 supplies timing signals such as clock signals and start pulses to each circuit.

The scanning line driving circuit 60 supplies scanning signals to each of the scanning lines Y1, Y2, . . . , Ym based on timing signals supplied from the controller 10.

The data line driving circuit 70 supplies data signals to the data lines X1, X2, . . . , Xn based on timing signals supplied from the controller 10. The data signals take on potentials with 2 values, a high potential VH (for example, 15V) or a low potential VL (for example, 0V).

The common potential supply circuit 220 supplies a common potential Vcom to a common potential line 93.

In addition, various types of signals are input and output in the controller 10, the scanning line driving circuit 60, the data line driving circuit 70, and the common potential supply circuit 220. However, descriptions of signals which have no particular relevance to the embodiment are not included.

Figure 2:
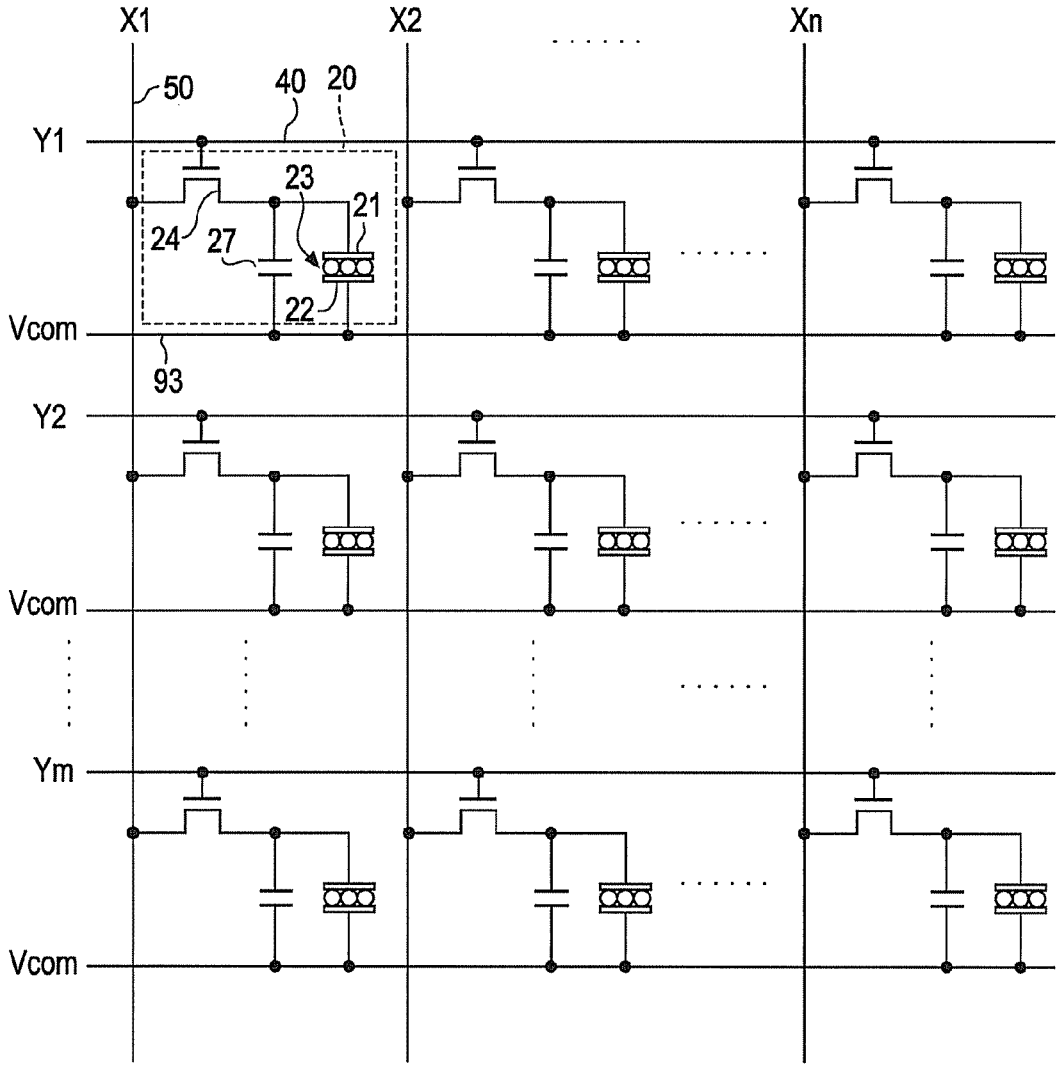
FIG. 2 is an equivalent circuit diagram illustrating an electrical configuration of a pixel of the electrophoretic display device according to the first embodiment.

FIG. 2 is an equivalent circuit diagram illustrating an electrical configuration of a pixel.

In FIG. 2, the pixel 20 includes a pixel circuit (namely, a 1T1C type pixel circuit) which has a pixel switching transistor 24 and a condenser (retention capacity) 27, a pixel electrode 21, a common electrode 22 and an electrophoretic layer 23.

The pixel switching transistor 24 is configured as, for example, an N type transistor. The gate of the pixel switching transistor 24 is electrically connected to the scanning line 40, the source of the pixel switching transistor 24 is electrically connected to the data line 50, and the drain of the pixel switching transistor 24 is electrically connected to the pixel electrode 21 and the condenser 27. The pixel switching transistor 24 outputs the data signals supplied from the data line driving circuit 70 (refer to FIG. 1) via the data line 50 to the pixel electrode 21 and the condenser 27 at a timing corresponding to the scanning signals supplied from the scanning lines driving circuit 60 (refer to FIG. 1) via the scanning line 40.

In the pixel electrode 21, the data signals are supplied from the data line driving circuit 70 via the data line 50 and the pixel switching transistor 24. The pixel electrode 21 is arranged to face the common electrode 22 through the electrophoretic layer 23.

The common electrode 22 is electrically connected to the common potential line 93 which is supplied with the common potential Vcom.

The electrophoretic layer 23 includes a plurality of microcapsules which each include electrophoretic particles.

The condenser 27 is formed from a pair of electrodes arranged to face each other through a dielectric film. One of the electrodes is electrically connected to the pixel electrode 21 and the pixel switching transistor 24, and the other electrode is electrically connected to the common potential line 93. It is possible to hold the data signals only for a predetermined period of time using the condenser 27.

Next, a specific configuration of a display unit of the electrophoretic display device according to the embodiment is described with reference to FIGS. 3 and 4.

Figure 3:
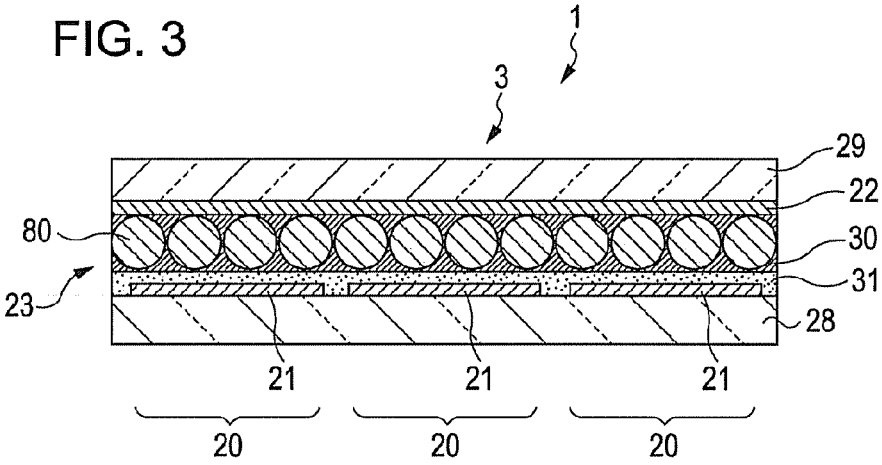
FIG. 3 is a partial cross-sectional diagram of a display unit of the electrophoretic display device according to the first embodiment.

FIG. 3 is a partial cross-sectional diagram of the display unit of the electrophoretic display device according to the embodiment.

In FIG. 3, the display unit 3 has the configuration where the electrophoretic layer 23 is interposed between an element substrate 28 and an opposing substrate 29. In addition, in the embodiment, the description is made assuming that an image is displayed on the opposing substrate 29 side.

The element substrate 28 is a substrate formed from, for example, glass, plastic or the like. Although not shown diagrammatically here, on the element substrate 28, a laminate structure is formed with the pixel switching transistor 24, the condenser 27, the scanning line 40, the data line 50, the common potential line 93 and the like described above with reference to FIG. 2. A plurality of the pixel electrodes 21 are provided in a matrix shape on the upper layer side of the laminate structure.

The opposing substrate 29 is a transparent substrate formed from, for example, glass, plastic or the like. On a surface of the opposing substrate 29 which faces the element substrate 28, the common electrode 22 is provided to face the plurality of pixel electrodes 21 in a covering form. The common electrode 22 is formed from a transparent and conductive material such as, for example, magnesium-silver (MgAg), indium tin oxide (ITO), and indium zinc oxide (IZO).

The electrophoretic layer 23 includes a plurality of microcapsules 80 which each include electrophoretic particles and is fixed between the element substrate 28 and the opposing substrate 29 by a binder 30 and an adhesive layer 31 formed from, for example, resin or the like. In addition, the electrophoretic display device 1 according to the embodiment is configured in a manufacturing process by an electrophoretic sheet, which is formed from the electrophoretic layer 23 being fixed in advance to the opposing substrate 29 side by the binder 30, being attached to the element substrate 28 side where the pixel electrode 21 and the like, which are manufactured separately, are bonded by the adhesive layer 31.

The microcapsules 80 are interposed between the pixel electrode 21 and the common electrode 22, and one or a plurality are arranged in one pixel 20 (in other words, in relation to one pixel electrode 21).

Figure 4:
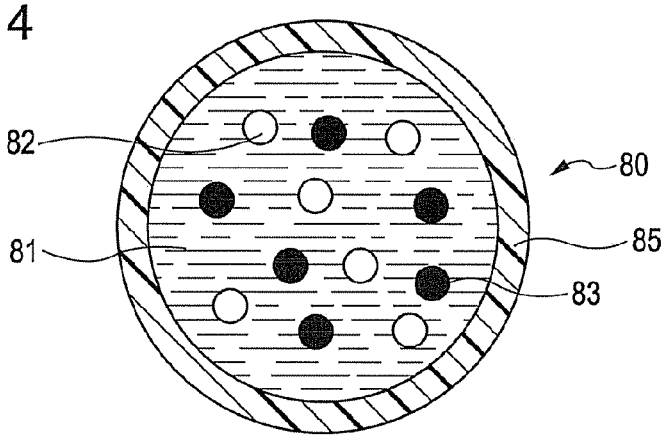
FIG. 4 is a schematic diagram illustrating a configuration of a microcapsule.

FIG. 4 is a schematic diagram illustrating a configuration of a microcapsule. In addition, in FIG. 4, a cross-section of the microcapsule is schematically shown.

In FIG. 4, the microcapsules 80 have enclosed a dispersion medium 81 inside of a capsule 85, a plurality of white particles 82 and a plurality of black particles 83. The microcapsules 80 are formed in a spherical shape with a particle diameter of, for example, approximately 50 μm.

The capsule 85 functions as the outer shell of the microcapsule 80 and is formed from a transparent polymer resin such as an acrylic resin such as polymethyl methacrylate or polyethyl ethacrylate, urea resin, gum Arabic or gelatin.

The dispersion medium 81 is a medium dispersing the white particles 82 and the black particles 83 in the microcapsules 80 (in other words, in the capsule 85). As the dispersion medium 81, water, alcohol based solvents such as methanol, ethanol, isopropanol, butanol, octanol, or methyl cellosolve, various types of esters such as ethyl acetate or butyl acetate, ketones such as acetone, methyl ethyl ketone or methyl isobutyl ketone, aliphatic hydrocarbons such as pentane, hexane, or octane, alicyclic hydrocarbons such as cyclohexane or methylcyclohexane, aromatic hydrocarbons such as benzene, toluene, xylene or benzenes with a long-chain alkyl group such as hexyl benzene, heptyl benzene, octyl benzene, nonyl benzene, decyl benzene, undecyl benzene, dodecyl benzene, tridecyl benzene or tetradecyl benzene, halogenated hydrocarbons such as methylene chloride, chloroform, carbon tetrachloride or 1,2-dichloroethane, carboxylate or other oils, can be used singularly or in combination. Also, in the dispersion medium 81, a surfactant may be included.

The white particles 82 are particles (polymer or colloid) formed from a white pigment such as titanium dioxide, Chinese white (zinc oxide) or antimony trioxide, and for example, are negatively charged.

The black particles 83 are particles (polymer or colloid) formed from a black pigment such as aniline black or carbon black, and for example, are positively charged.

As a result, the white particles 82 and the black particles 83 can be moved within the dispersion medium 81 using an electrical field generated by a difference in potential between the pixel electrode 21 and the common electrode 22.

In these pigments, electrolytes, surfactants, metallic soaps, resins, rubber, oils, varnishes, charge control agents formed from particles such as compounds, dispersants such as titanium-based coupling agents, aluminum-based coupling agents and silane-based coupling agents, lubricants, stabilizers and the like can be added as required.

In the FIGS. 3 and 4, in a case when a voltage is applied between the pixel electrode 21 and the common electrode 22 so that the potential of the common electrode 22 becomes relatively higher, the black particles 83 which are positively charged are drawn toward the pixel electrode 21 side in the microcapsule 80 due to Coulomb force and the white particles 82 which are negatively charged are drawn toward the common electrode 22 side in the microcapsule 80 due to Coulomb force. As a result, due to the white particles 82 collecting at the display surface side in the microcapsule 80 (that is, the common electrode 22 side), it is possible to display the color of the white particles 82 (that is, white) on the display surface of the display unit 3. Conversely, in a case when a voltage is applied between the pixel electrode 21 and the common electrode 22 so that the potential of the pixel electrode 21 becomes relatively higher, the white particles 82 which are negatively charged are drawn toward the pixel electrode 21 side due to Coulomb force and the black particles 83 which are positively charged are drawn toward the common electrode 22 side due to Coulomb force. As a result, due to the black particles 83 collecting at the display surface side in the microcapsule 80, it is possible to display the color of the black particles 83 (that is, black) on the display surface of the display unit 3.

In addition, below, in the case when the potential of the common electrode 22 is higher than the potential of the pixel electrode 21, the difference in potential (that is, voltage) generated between the common electrode 22 and the pixel electrode 21 is appropriately referred to as a "positive polarity voltage", and in the case when the potential of the common electrode 22 is lower than the potential of the pixel electrode 21, the difference in potential generated between the common electrode 22 and the pixel electrode 21 is appropriately referred to as a "negative polarity voltage". In addition, the common electrode 22 is an example of the "first electrode" according to the invention, and the pixel electrode 21 is an example of the "second electrode" according to the invention. Furthermore, positive polarity is an example of the "first polarity" according to the invention, and negative polarity is an example of the "second polarity" according to the invention.

That is, it is possible to display white in the pixel 20 by applying a positive polarity voltage to the pixel 20, and it is possible to display black in the pixel 20 by applying a negative polarity voltage to the pixel 20. In addition, a state where the pixel 20 displays white is an example of the "first display state" according to the invention and a state where the pixel 20 displays black is an example of the "second display state" according to the invention.

In addition, the common electrode 22 may be set as the "second electrode" according to the invention, and the pixel electrode 21 may be set as the "first electrode" according to the invention.

Furthermore, it is possible to display grays, such as light gray, gray and dark gray, which are halftones (that is, intermediate gradation) between white and black due to the dispersion state of the white particles 82 and the black particles 83 between the pixel electrodes 21 and the common electrodes 22. For example, after the white particles 82 collect at the display surface side of the microcapsule 80 and the black particles 83 collect at the pixel electrode 21 side due to a voltage applied between the pixel electrode 21 and the common electrode 22 so that the potential of the common electrode 22 becomes relatively higher (that is, by applying a positive polarity voltage), the black particles 83 are moved by only a predetermined amount to the display surface side of the microcapsule 80 and the white particles 82 are moved by a predetermined amount only to the pixel electrode 21 side due to a voltage applied between the pixel electrode 21 and the common electrode 22 so that the potential of the pixel electrode 21 becomes relatively higher (that is, by applying a negative polarity voltage) for only a predetermined period of time corresponding to halftone to be displayed. As a result, it is possible to display gray which is a halftone between white and black on the display surface of the display unit 3.

In addition, it is possible to display red, green, blue and the like by changing the pigments used in the white particles 82 and the black particles 83 with, for example, pigments which are red, green, blue or the like.

Next, a driving method of the electrophoretic display device according to the embodiment will be described with reference to FIGS. 5 to 11.

Figure 5:
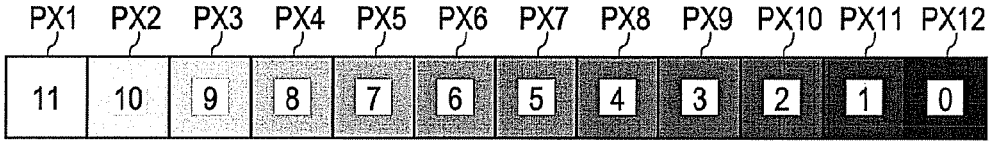
FIG. 5 is a schematic diagram illustrating the display unit of the electrophoretic display device in a state where an example of an image including a plurality of halftones is displayed.

Below, a case, where an image including a plurality of halftones as shown in FIG. 5 is displayed on the display unit 3, is taken as an example. Here, FIG. 5 is a schematic diagram illustrating the display unit of the electrophoretic display device in a state where an example of an image including a plurality of halftones is displayed. An image including a plurality of halftones shown in FIG. 5 is an image with 12 gradations, and the $0^{th}$ gradation corresponds to black, the $1^{st}$ gradation to the $10^{th}$ gradation correspond to grays which each have different densities, and the $11^{th}$ gradation corresponds to white. Additionally, for the sake of description, in the display unit 3, 12 pixels 20 (that is, pixels PX1, PX2, . . . , PX12) are arranged.

That is, as shown in FIG. 5, a case, where the pixel PX1 displays the $11^{th}$ gradation, the pixel PX2 displays the $10^{th}$ gradation, the pixel PX3 displays the $9^{th}$ gradation, the pixel PX4 displays the $8^{th}$ gradation, the pixel PX5 displays the $7^{th}$ gradation, the pixel PX6 displays the $6^{th}$ gradation, the pixel PX7 displays the $5^{th}$ gradation, the pixel PX8 displays the $4^{th}$ gradation, the pixel PX9 displays the $3^{rd}$ gradation, the pixel PX10 displays the $2^{nd}$ gradation, the pixel PX11 displays the $1^{st}$ gradation, and the pixel PX12 displays the $0^{st}$ gradation, is taken as an example.

Figure 6:
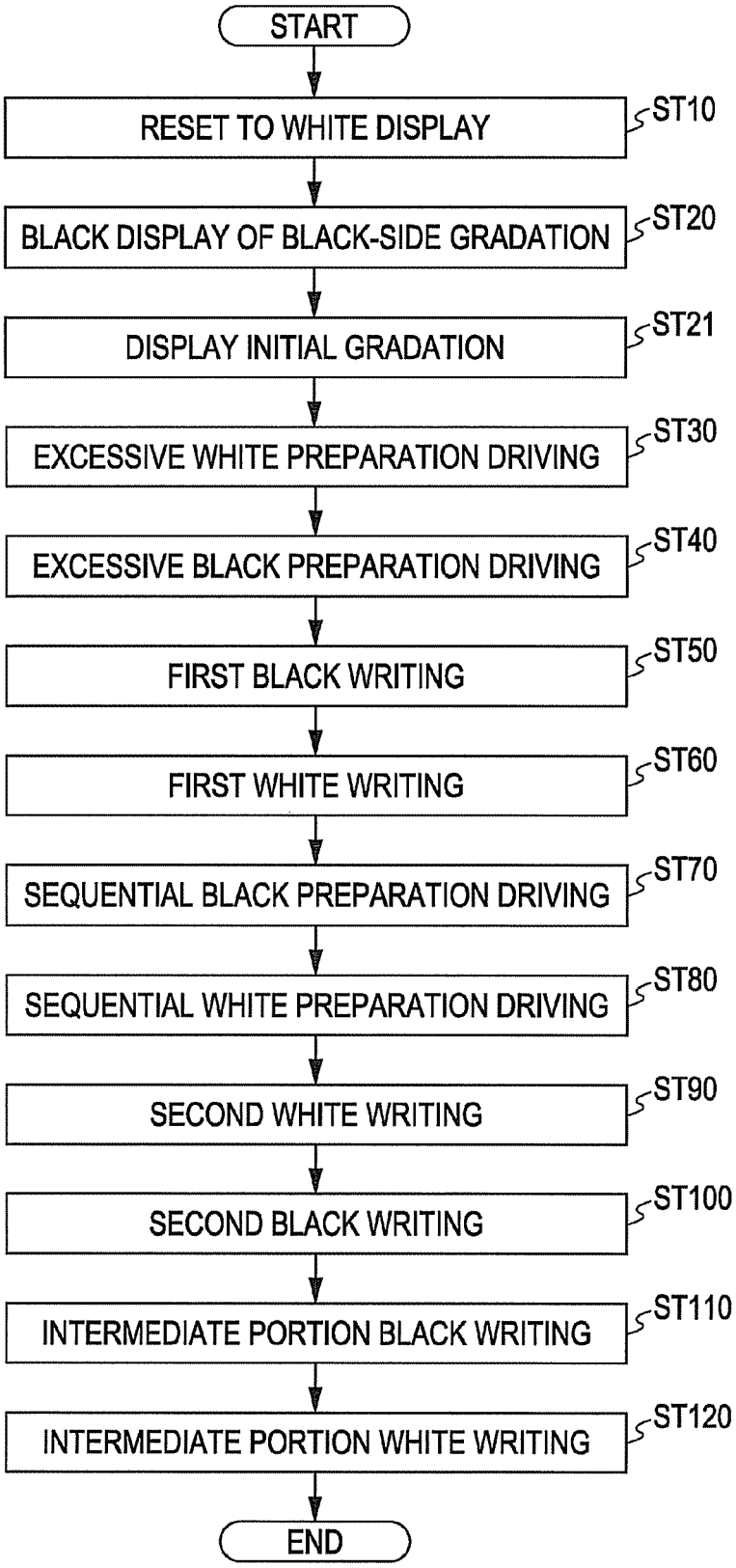
FIG. 6 is a flow chart illustrating a driving method of the electrophoretic display device according to the first embodiment.

FIG. 6 is a flow chart illustrating the driving method of the electrophoretic display device according to the embodiment, and FIGS. 7A to 9D are schematic diagrams illustrating display states of pixels PX1 to PX12 when each step shown in FIG. 6 is performed.

In FIG. 6, according to the driving method of the electrophoretic display device according to the embodiment, when displaying an image including halftone as show in FIG. 5 for example, first, a reset to white display is performed (step ST10). That is, as shown in FIG. 7A, all of the pixels 20 display white (that is, the $11^{th}$ gradation) due to a positive polarity voltage being applied to all of the pixels 20 in the display unit 3. More specifically, in each of the pixels 20, data signals from the data line 50 via the pixel switching transistor 24 accumulate in the condenser 27, a voltage with the high potential VH is supplied to the pixel electrode 21 only for a predetermined period of time, and the common potential Vcom fixed at the low potential VL is supplied to the common electrode 22 from the common potential supply circuit 220.

Next, in FIG. 6, black-side gradation pixels display black (step ST20). That is, as shown in FIG. 7B, out of the plurality of pixels 20 in the display unit 3, black (that is, the $0^{th}$ gradation) is displayed in the pixels PX7 to PX12 which are to display gradations (that is, in the example in FIG. 5, from the $0^{th}$ gradation to the $5^{th}$ gradation) close to the black (that is, the $0^{th}$ gradation) side. More specifically, in each of the pixels PX7 to PX12, data signals from the data line 50 via the pixel switching transistor 24 accumulate in the condenser 27, a voltage with the low potential VL is supplied to the pixel electrode 21 only for a predetermined period of time, and the common potential Vcom which is constant at the high potential VH is supplied to the common electrode 22 from the common potential supply circuit 220.

Next, in FIG. 6, initial gradation display is performed (step ST21). That is, as shown in FIG. 7C, out of the pixels PX1 to PX6 displaying white (that is, the $11^{th}$ gradation) in the display unit 3, the pixel PX3 which is to display the $9^{th}$ gradation, the pixel PX4 which is to display the $8^{th}$ gradation, the pixel PX5 which is to display the $7^{th}$ gradation and the pixel PX6 which is to display the $6^{th}$ gradation are supplied with a negative polarity voltage pulse, that is, between the pixel electrode 21 and the common electrode 22 of each of the pixel PX3 which is to display the $9^{th}$ gradation, the pixel PX4 which is to display the $8^{th}$ gradation, the pixel PX5 which is to display the $7^{th}$ gradation and the pixel PX6 which is to display the $6^{th}$ gradation are applied with a negative polarity voltage, and thus, a gradation (for example, the $9^{th}$ gradation) between the $11^{th}$ gradation and the $6^{th}$ gradation is displayed in each of the pixels PX3 to PX6.

Furthermore, out of the pixels PX7 to PX10 displaying black (that is, the $0^{th}$ gradation) in the display unit 3, the pixel PX10 which is to display the $2^{nd}$ gradation, the pixel PX9 which is to display the $3^{rd}$ gradation, the pixel PX8 which is to display the $4^{th}$ gradation and the pixel PX7 which is to display the $5^{th}$ gradation are supplied with a positive polarity voltage, that is, between the pixel electrode 21 and the common electrode 22 of each of the pixel PX10 which is to display the $2^{nd}$ gradation, the pixel PX9 which is to display the $3^{rd}$ gradation, the pixel PX8 which is to display the $4^{th}$ gradation and the pixel PX7 which is to display the $5^{th}$ gradation are applied with a positive polarity voltage, and thus, a gradation (for example, the $2^{nd}$ gradation) between the $0^{th}$ gradation and the $5^{th}$ gradation is displayed in each of the pixels PX7 to PX10.

Here, in the embodiment, in particular, when displaying an image including a halftone as shown in FIG. 5 for example, in the initial gradation display (step ST21), each of the pixels PX3 to PX6 display, for example, a halftone (for example, the $9^{th}$ gradation) closer to the halftone to be displayed in each of the pixels PX3 to PX6 than to white (the $11^{th}$ gradation) and each of the pixels PX7 to PX10 display, for example, a halftone (for example, the $2^{nd}$ gradation) closer to the halftone to be displayed in each of the pixels PX7 to PX10 than to black (the $0^{th}$ gradation). As such, when displaying an image including halftone as shown in FIG. 5 for example, it is possible to quickly display the image to be displayed in a gradation rougher than the gradation to be displayed. In other words, when displaying an image including halftone as shown in FIG. 5 for example, it is possible to display an image close to the image to be displayed at an initial stage. Accordingly, it is possible for a user to promptly visually recognize the content of the image to be displayed.

In the initial gradation display (step ST21), if the precision of the gradation level displayed in the pixels PX3 to PX10 is low, the expressiveness of gradations in an image finally obtained is lowered. Therefore, in the step ST21, in the case when the precision of the gradation level displayed in the pixels PX3 to PX10 is low, it is preferable if the precision is increased using the methods below.

First, a positive polarity compensating voltage pulse Pc1 is initially applied to the pixels PX3 to PX6 displaying the $11^{th}$ gradation. By applying the positive polarity compensating voltage pulse Pc1, Coulomb force toward the common electrode 22 side (that is, the display surface side) is added to the white particles 82 and Coulomb force toward the pixel electrode 21 side is added to the black particles 83. After that, the pixels PX3 to PX6 are applied with a negative polarity voltage pulse for displaying the $9^{th}$ gradation. The shorter the interval between the negative polarity voltage pulse for displaying the $9^{th}$ gradation and the compensating voltage pulse Pc1, the higher the precision of the gradation level becomes. On the other hand, first, a negative polarity compensating voltage pulse Pc2 is initially applied to the pixels PX7 to PX10 displaying the $0^{th}$ gradation. By applying the negative polarity compensating voltage pulse Pc2, Coulomb force toward the common electrode 22 side (that is, display surface side) is added to the black particles 83 and Coulomb force toward the pixel electrode 21 side is added to the white particles 82. After that, the pixels PX7 to PX10 are applied with a positive polarity voltage pulse for displaying the $2^{nd}$ gradation. The shorter the interval between the positive polarity voltage pulse for displaying the $2^{nd}$ gradation and the negative polarity compensating voltage pulse Pc2, the higher the precision of the gradation level becomes.

In order to increase the precision of the gradation level, the precision may be increased using a second method described next. First, a negative polarity voltage pulse is initially applied to the pixels PX3 to PX6 displaying the $11^{th}$ gradation. Next, a positive polarity compensating voltage pulse Pc3 is applied to the pixels PX3 to PX6. On the other hand, a positive polarity voltage pulse is initially applied to the pixels PX7 to PX10 displaying the $0^{th}$ gradation. Next, a negative polarity compensating voltage pulse Pc4 is applied to the pixels PX7 to PX10. Through to the second method, the precision of the gradation level becomes higher.

Figures 12, 13:
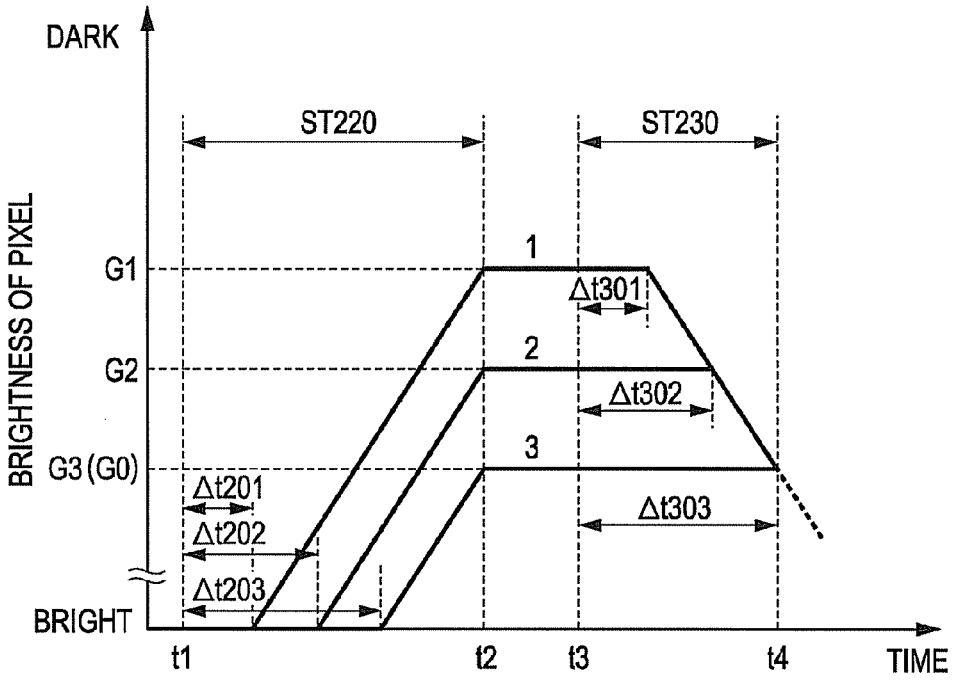
FIG. 12 is a conceptual diagram illustrating an operation of the electrophoretic display device according to the first embodiment.
FIG. 13 is a schematic diagram for describing a step ST20'.

An operation according to the invention will be described using FIG. 12. FIG. 12 is a conceptual diagram illustrating an operation of the electrophoretic display device according to the embodiment. In addition, FIG. 12 conceptually shows a change in a density of a color displayed in the pixel which is to display the $9^{th}$ gradation due to black writing (step ST220) and white writing (step ST230). From a timing t1 to a timing t2 corresponds to step ST220 and from a timing t3 to a timing t4 corresponds to the step ST230. Additionally, a plot 1 shows a change of brightness (color density) in, for example, pixel PX3, a plot 2 shows a change of brightness (color density) in, for example, pixel PX4 and a plot 3 shows a change of brightness (color density) in, for example, pixel PX5. Furthermore, Δt is a delay time from when a negative polarity voltage is applied to when brightness begins to change, Δt201 is a delay time in step ST20 for pixel PX3, Δt202 is a delay time in step ST20 for pixel PX4, Δt203 is a delay time in step ST20 for pixel PX5, Δt301 is a delay time in step ST30 for pixel PX3, Δt302 is a delay time in step ST30 for pixel PX4, and Δt303 is a delay time in step ST30 for pixel PX5.

Here, the gradation to be displayed in pixel PX3, the gradation to be displayed in pixel PX4 and the gradation to be displayed in pixel PX5 are all the $9^{th}$ gradation (G0), and negative polarity driving voltages which have a duration which is the same as each other are applied to each of the pixel PX3, the pixel PX4 and the pixel PX5. Normally, in the step ST220, in a case when negative polarity driving voltages which have duration which are the same as each other are applied to each of the pixel PX3, the pixel PX4 and the pixel PX5 to display the gradation G0, at the timing t2 when the step ST220 ends, the brightness of the pixel PX3, the brightness of the pixel PX4 and the brightness of the pixel PX5 should all become G0. However, in reality, as shown in FIG. 12, since there are cases when the delay time Δt differs by pixel, at the timing t2, the brightness of the pixel PX3 becomes G1, the brightness of the pixel PX4 becomes G2 and the brightness of the pixel PX5 becomes G3 (G0). A difference in the brightness G1 and the brightness G3 (G0) is a cause of the precision of gradation display being lowered. The lowering of the precision of gradation display is notable as the duration of the voltage applied to display gradation is shorter.

Therefore, the step ST230 is executed after the step ST220. First, in the step ST220, negative polarity driving voltages which have a duration which is the same as each other are applied to each of the pixel PX3, the pixel PX4 and the pixel PX5 as described previously. Next, in the step ST230, if the positive polarity compensating voltage pulses Pc3 which have a duration which is the same as each other are applied to each of the pixel PX3, the pixel PX4 and the pixel PX5, the brightness of the pixel PX3 begins to change toward the bright direction after the delay time Δt301 and the brightness of the pixel PX4 begins to change toward the bright direction after the delay time Δt302. However, here, since the duration of the step ST230 is set to be the same as the delay time Δt303 of the pixel PX5, the brightness of the pixel PX5 does not change during the step ST230 and the brightness G0 is maintained.

According to experiments by the inventors, the cause generating the delay time is considered to be related to the presence of a threshold voltage for beginning to move the electrophoretic particles and that a sufficient voltage is not being applied to the electrophoretic layer unless sufficient charge is accumulated in the condenser 27. In order for a sufficient voltage to be applied to the pixel to begin moving the electrophoretic particles, it is necessary for a sufficient charge to accumulate in the condenser 27. However, if there are individual differences in the charging speeds of the condensers 27 due to manufacturing variations, it is considered that the required time from the application of a voltage to the condenser 27 to the sufficient charge being applied to the pixel is different depending on the pixel. This phenomenon is considered to be one cause of a difference in the delay time Δt depending on the pixel. In addition, the delay time Δt201 is substantially the same as the delay time Δt301, the delay time Δt202 is substantially the same as the delay time Δt302, and the delay time Δt203 is substantially the same as the delay time Δt303.

In this manner, in the timing t4 of the completion of the step ST230, the brightness of the pixel PX3, the brightness of the pixel PX4 and the brightness of the pixel PX5 all become substantially the same, and it is possible to display the same as the target gradation G0 or substantially the same gradation in each of the pixel PX3, the pixel PX4 and the pixel PX5. That is, it is possible to increase the precision of gradation display.

In the step ST230, even if the durations of the compensating voltages applied to each of two pixel are different for each other, since it is possible to reduce a difference in the brightness of the respective two pixels, an effect of increasing the precision of gradation display can be obtained.

In FIG. 12, the continuous time of the step ST230 is set to be the same as the delay time Δt303 of the pixel PX5, but it is not necessarily required to be the same. If the continuous time of the step ST230 is at least longer than the delay time Δt303 of the pixel PX5, the effect of increasing the precision of gradation display can be obtained. If the continuous time of the step ST230 is longer than the delay time Δt303 of the pixel PX5, the brightness of the pixel PX3, the brightness of the pixel PX4 and the brightness of the pixel PX5 all change toward a bright state as shown in an undulating line. However, when the step ST230 ends, it is possible that the brightness of the pixel PX3, the brightness of the pixel PX4 and the brightness of the pixel PX5 all display substantially the same gradation. That is, it is possible to increase the precision of gradation display.

Additionally, in FIG. 12, there is an interval opened up between the step ST220 and the step ST230, but a shorter interval makes it possible to further effectively increase the precision of gradation display. It is preferable if there is no interval.

In order to increase the precision of gradation display, a third method described next may be used. In the example shown in FIG. 7B, when the black-side gradation pixels display black (step ST20), the display states of the pixels PX7 to PX12 are set to the $0^{th}$ gradation, but instead of this, as a step ST20', the pixels PX3 to PX6, the pixel PX11 and the pixel PX12 are set to the $0^{th}$ gradation as shown in FIG. 13. Then, in step ST21, a positive polarity voltage pulse for displaying the $9^{th}$ gradation is applied to the pixels PX3 to PX6, and a negative polarity voltage pulse for displaying the $2^{nd}$ gradation is applied to the pixels PX7 to PX10. That is, if the target gradation level in the initial gradation display is a gradation close to white, the gradation is written from a far-off black in step ST20, and if the target gradation level in the initial gradation display is a gradation close to black, the gradation is written from a far-off white in step ST20. As already described, the lowering of the precision of gradation display is notable as the duration of the voltage applied to display gradation is shorter. According to the third method, since a change in the gradation level displayed in the pixels PX3 to PX10 in step ST21 is large compared to the method described using FIG. 7, the duration of the voltage applied to the pixels PX3 to PX10 is long. As a result, it is possible to increase gradation precision in the pixels PX3 to PX10 more than the method described using FIG. 7.

Next, in FIG. 6, excessive white preparation driving (step ST30) is performed. That is, by supplying positive polarity voltage pulses to the pixels 20 which are to display the $11^{th}$ gradation and the pixels 20 which are to display the $10^{th}$ gradation out of the plurality of pixels 20 in the display unit 3, that is, by supplying positive polarity voltages between the pixel electrodes 21 and the common electrodes 22 of each of the pixels 20 which are to display the $11^{th}$ gradation and the pixels 20 which are to display the $10^{th}$ gradation, Coulomb force toward the common electrode 22 side (that is, display surface side) is added to the white particles 82 and Coulomb force toward the pixel electrode 21 side is added to the black particles 83. In the example in FIG. 5, out of the plurality of pixels 20 in the display unit 3, the pixel PX1 which is to display the $11^{th}$ gradation is supplied with a positive polarity voltage pulse P1 (refer to FIG. 10 described later), and the pixel PX2 which is to display the $10^{th}$ gradation is supplied with a positive polarity voltage pulse P2 (refer to FIG. 10 described later). In addition, the pixel PX1 is an example of the "first pixel" according to the invention, and the pixel PX2 is an example of the "second pixel" according to the invention. The voltage pulse P1 is an example of the "first voltage pulse" according to the invention, and the voltage pulse P2 is an example of the "third voltage pulse" according to the invention. As such, as shown in FIG. 7D, the pixel PX1 and PX2 become a state where the white particles 82 are drawn to the common electrode 22 side more than a state where the $11^{th}$ gradation is displayed (below, for the sake of description, it is appropriately described as the gradation state higher than the $11^{th}$ gradation). Here, a duration of the positive polarity voltage pulse supplied to the pixels 20 which are to display the $11^{th}$ gradation and a duration of the positive polarity voltage pulse supplied to the pixels 20 which are to display the $10^{th}$ gradation are different from each other. In the embodiment, a duration T1 of the positive polarity voltage pulse P1 supplied to the pixel PX1 which is to display the $11^{th}$ gradation is longer than a duration T2 of the positive polarity voltage pulse P2 supplied to the pixel PX2 which is to display the $10^{th}$ gradation. As such, the pixel PX1 becomes a state where the white particles 82 are drawn to the common electrode 22 side more than the pixel PX2. Accordingly, as shown in FIG. 7D, the pixel PX1 is in a state of, for example, a $15^{th}$ gradation and the pixel PX2 is in a state of, for example, a $13^{th}$ gradation. In addition, the $15^{th}$ gradation and the $13^{th}$ gradation here are for conveniently showing the degree of the state to which the white particles 82 are drawn to the common electrode 22 side and differ as a display state from the $0^{th}$ gradation to the $11^{th}$ gradation. Both, for example, the pixel PX1 in the state of the $15^{th}$ gradation and, for example, the pixel PX2 in the state of the $13^{th}$ gradation display white (that is, the $11^{th}$ gradation).

Next, in FIG. 6, excessive black preparation driving is performed (step ST40). That is, by supplying negative polarity voltage pulses to the pixels 20 which are to display the $0^{th}$ gradation and the pixels 20 which are to display the $1^{st}$ gradation out of the plurality of pixels 20 in the display unit 3, that is, by supplying negative positive polarity voltages between the pixel electrodes 21 and the common electrodes 22 of each of the pixels 20 which are to display the $0^{th}$ gradation and the pixels 20 which are to display the $1^{st}$ gradation, Coulomb force toward the common electrode 22 side (that is, display surface side) is added to the black particles 83 and Coulomb force toward the pixel electrode 21 side is added to the white particles 82. In the example in FIG. 5, out of the plurality of pixels 20 in the display unit 3, the pixel PX12 which is to display the $0^{th}$ gradation is supplied with a negative polarity voltage pulse P12 (refer to FIG. 11 described later), and the pixel PX11 which is to display the $1^{st}$ gradation is supplied with a negative polarity voltage pulse P11 (refer to FIG. 11 described later). In addition, the pixel PX12 is an example of the "third pixel" according to the invention, and the pixel PX11 is an example of the "fourth pixel" according to the invention. The voltage pulse P12 is an example of the "fourth voltage pulse" according to the invention, and the voltage pulse P11 is an example of the "sixth voltage pulse" according to the invention. As such, as shown in FIG. 7E, the pixel PX11 and PX12 become a state where the black particles 83 are drawn to the common electrode 22 side more than a state where the $0^{th}$ gradation is displayed (below, for the sake of description, it is appropriately described as the gradation state lower than the $0^{th}$ gradation). Here, a duration of the negative polarity voltage pulse supplied to the pixels 20 which are to display the $0^{th}$ gradation and a duration of the negative polarity voltage pulse supplied to the pixels 20 which are to display the $1^{st}$ gradation are different from each other. In the embodiment, a duration T12 of the positive polarity voltage pulse P12 supplied to the pixel PX12 which is to display the $0^{th}$ gradation is longer a duration T11 of the positive polarity voltage pulse P11 supplied to the pixel PX11 which are to display the $1^{st}$ gradation. As such, the pixel PX12 becomes a state where the black particles 83 are drawn to the common electrode 22 side more than the pixel PX11. Accordingly, as shown in FIG. 7E, the pixel PX12 is in a state of, for example, a $-4^{th}$ gradation and the pixel PX11 is in a state of, for example, a $-2^{nd}$ gradation. In addition, the $-4^{th}$ gradation and the $-2^{nd}$ gradation here are for conveniently showing the degree of the state to which the black particles 83 are drawn to the common electrode 22 side and differ as a display state from the $0^{th}$ gradation to the $11^{th}$ gradation. Both, for example, the pixel PX12 in the state of the $-4^{th}$ gradation and, for example, the pixel PX11 in the state of the $-2^{nd}$ gradation display black (that is, the $0^{th}$ gradation).

Next, in FIG. 6, first black writing is performed (step ST50). That is, out of the plurality of pixels 20 in the display unit 3, the pixels 20, which are set to a state of a gradation higher than the gradation to be displayed by the excessive white preparation driving (step ST30), are supplied with a negative polarity voltage pulse. In the example in FIG. 5, out of the plurality of pixels 20 in the display unit 3, the pixel PX1 and the pixel PX2 where the excessive white preparation driving has been performed (step ST30) are supplied with a negative polarity voltage pulse Pb1 (refer to FIG. 10 described later). In addition, the voltage pulse Pb1 is an example of the "second voltage pulse" according to the invention. According to this, as shown in FIG. 8A, it is possible for the pixel PX1 to display the $11^{th}$ gradation (that is, white) and for the pixel PX2 to display the $10^{th}$ gradation. That is, it is possible for the pixel PX1 and the pixel PX2 to display the gradation to be displayed.

Next, in FIG. 6, first white writing is performed (step ST60). That is, out of the plurality of pixels 20 in the display unit 3, the pixels 20, which are set to a state of a gradation lower than the gradation to be displayed by the excessive black preparation driving (step ST40), are supplied with a positive polarity voltage pulse. In the example in FIG. 5, out of the plurality of pixels 20 in the display unit 3, the pixel PX12 and the pixel PX11 where the excessive black preparation driving (step ST40) has been performed are supplied with a positive polarity voltage pulse Pw1 (refer to FIG. 11 described later). In addition, the voltage pulse Pw1 is an example of the "fifth voltage pulse" according to the invention. According to this, as shown in FIG. 8B, it is possible for the pixel PX12 to display the $0^{th}$ gradation (that is, black) and for the pixel PX11 to display the $1^{st}$ gradation. That is, it is possible for the pixel PX12 and the pixel PX11 to display the gradation to be displayed.

Next, in FIG. 6, sequential black preparation driving is performed (step ST70). That is, out of the plurality of pixels 20 in the display unit 3, the pixels 20 which are to display the $9^{th}$ gradation, the pixels 20 which are to display the $8^{th}$ gradation, the pixels 20 which are to display the $7^{th}$ gradation and the pixels 20 which are to display the $6^{th}$ gradation are supplied with a negative polarity voltage pulse. That is, a negative polarity voltage is applied between the pixel electrodes 21 and the common electrodes 22 of each of the pixels 20 which are to display the $9^{th}$ gradation, the pixels 20 which are to display the $8^{th}$ gradation, the pixels 20 which are to display the $7^{th}$ gradation and the pixels 20 which are to display the $6^{th}$ gradation. Thus, the black particles 83 are moved to the common electrode 22 side (that is, display surface side) and the white particles 82 are moved to the pixel electrode 21 side. In the example of FIG. 5, out of the plurality of pixels 20 in the display unit 3, the pixel PX3 which is to display the $9^{th}$ gradation and the pixel PX5 which is to display the $7^{th}$ gradation are supplied with a negative polarity voltage pulse P3 (refer to FIG. 10 described later), and the pixel PX4 which is to display the $8^{th}$ gradation and the pixel PX6 which is to display the $6^{th}$ gradation are supplied with a negative polarity voltage pulse P4 (refer to FIG. 10 described later). The pixel PX3 and the pixel PX5 are examples of the "first pixel" according to the invention, and the pixel PX4 and the pixel PX6 are examples of the "second pixel" according to the invention. The voltage pulse P3 is an example of the "first voltage pulse" according to the invention, and the voltage pulse P4 is an example of the "third voltage pulse" according to the invention. Here, the duration of the negative voltage pulse supplied to the pixel 20 which is to display the $9^{th}$ gradation and the $7^{th}$ gradation and the duration of the negative voltage pulse supplied to the pixel 20 which is to display the $8^{th}$ gradation and $6^{th}$ gradation are different from each other. In the embodiment, a duration T4 of the negative polarity voltage pulse P4, which is supplied to the pixel PX4 which is to display the $8^{th}$ gradation and the pixel PX6 which is to display the $6^{th}$ gradation, is longer than a duration T3 of the negative polarity voltage pulse P3, which is supplied to the pixel PX3 which is to display the $9^{th}$ gradation and the pixel PX5 which is to display the $7^{th}$ gradation. As such the pixel PX4 and the pixel PX6 become a display state closer to black (that is, the $0^{th}$ gradation) than the pixel PX3 and the pixel PX5. Accordingly, as shown in FIG. 8C, the pixel PX3 and the pixel PX5 display, for example, the $6^{th}$ gradation and the pixel PX4 and the pixel PX6 display, for example, the $4^{th}$ gradation.

Next, in FIG. 6, sequential white preparation driving is performed (step ST80). That is, out of the plurality of pixels 20 in the display unit 3, the pixels 20 which are to display the $5^{th}$ gradation, the pixels 20 which are to display the $4^{th}$ gradation, the pixels 20 which are to display the $3^{rd}$ gradation and the pixels 20 which are to display the $2^{nd}$ gradation are supplied with a positive polarity voltage pulse. That is, a positive polarity voltage is applied between the pixel electrodes 21 and the common electrodes 22 of each of the pixels 20 which are to display the $5^{th}$ gradation, the pixels 20 which are to display the $4^{th}$ gradation, the pixels 20 which are to display the $3^{rd}$ gradation and the pixels 20 which are to display the $2^{nd}$ gradation. Thus, the white particles 82 are moved to the common electrode 22 side (that is, display surface side) and the black particles 83 are moved to the pixel electrode 21 side. In the example of FIG. 5, out of the plurality of pixels 20 in the display unit 3, the pixel PX10 which is to display the $2^{nd}$ gradation and the pixel PX8 which is to display the $4^{th}$ gradation are supplied with a positive polarity voltage pulse P10 (refer to FIG. 11 described later), and the pixel PX9 which is to display the $3^{th}$ gradation and the pixel PX7 which is to display the $5^{th}$ gradation are supplied with a positive polarity voltage pulse P9 (refer to FIG. 11 described later). In addition, the pixel PX10 and the pixel PX8 are examples of the "first pixel" according to the invention, and the pixel PX9 and the pixel PX7 are examples of the "second pixel" according to the invention. The voltage pulse P10 is an example of the "fourth voltage pulse" according to the invention, and the voltage pulse P9 is an example of the "sixth voltage pulse" according to the invention. Here, the duration of the negative voltage pulse supplied to the pixel 20 which is to display the $2^{nd}$ gradation and the $4^{th}$ gradation and the duration of the negative voltage pulse supplied to the pixel 20 which is to display the $3^{rd}$ gradation and $5^{th}$ gradation are different from each other. In the embodiment, a duration T9 of the positive polarity voltage pulse P9, which is supplied to the pixel PX9 which is to display the $3^{rd}$ gradation and the pixel PX7 which is to display the $5^{th}$ gradation, is longer than a duration T10 of the positive polarity voltage pulse P10, which is supplied to the pixel PX10 which is to display the $2^{nd}$ gradation and the pixel PX8 which is to display the $4^{th}$ gradation. As such the pixel PX9 and the pixel PX7 become a display state closer to white (that is, the $11^{th}$ gradation) than the pixel PX10 and the pixel PX8. Accordingly, as shown in FIG. 8D, the pixel PX10 and the pixel PX8 display, for example, the $5^{th}$ gradation and the pixel PX9 and the pixel PX7 display, for example, the $7^{th}$ gradation.

Next, in FIG. 6, second white writing is performed (step ST90). That is, out of the plurality of pixels 20 in the display unit 3, the pixels 20, which are set to a gradation lower than the gradation to be displayed by the sequential black preparation driving (step ST70), are supplied with a positive polarity voltage pulse. In the example in FIG. 5, out of the plurality of pixels 20 in the display unit 3, the pixel PX3 to PX6 where the sequential black preparation driving (step ST70) has been performed are supplied with a positive polarity voltage pulse Pw2 (refer to FIG. 10 described later). In addition, the voltage pulse Pw2 is an example of the "second voltage pulse" according to the invention. According to this, as shown in FIG. 9A, it is possible for the pixel PX3 to display the $9^{th}$ gradation and for the pixel PX4 to display the $8^{th}$ gradation. That is, it is possible for the pixel PX3 and the pixel PX4 to display the gradation to be displayed. At this time, the pixel PX5 displays, for example, the $9^{th}$ gradation and the pixel PX6 displays, for example, the $8^{th}$ gradation.

Next, in FIG. 6, second black writing is performed (step ST100). That is, out of the plurality of pixels 20 in the display unit 3, the pixels 20, which are set to a gradation higher than the gradation to be displayed by the sequential white preparation driving (step ST80), are supplied with a negative polarity voltage pulse. In the example in FIG. 5, out of the plurality of pixels 20 in the display unit 3, the pixel PX7 to PX10 where the sequential white preparation driving has been performed (step ST80) are supplied with a negative polarity voltage pulse Pb2 (refer to FIG. 11 described later). In addition, the voltage pulse Pb2 is an example of the "fifth voltage pulse" according to the invention. According to this, as shown in FIG. 9B, it is possible for the pixel PX10 to display the $2^{nd}$ gradation and for the pixel PX9 to display the $3^{rd}$ gradation. That is, it is possible for the pixel PX10 and the pixel PX9 to display the gradation to be displayed. At this time, the pixel PX8 displays, for example, the $2^{nd}$ gradation and the pixel PX7 displays, for example, the $3^{rd}$ gradation.

Next, in FIG. 6, intermediate portion black writing is performed (step ST110). That is, out of the plurality of pixels 20 in the display unit 3, the pixels 20, which are set to a gradation higher than the gradation to be displayed by the second white writing (step ST90), are supplied with a negative polarity voltage pulse. In the example in FIG. 5, out of the plurality of pixels 20 in the display unit 3, the pixel PX5 and the pixel PX6, which are set to a gradation higher than the gradation to be displayed by the second white writing (step ST90), are supplied with a negative polarity voltage pulse Pb3 (refer to FIG. 10 described later). In addition, the voltage pulse Pb3 is an example of the "seventh voltage pulse" according to the invention. According to this, as shown in FIG. 9C, it is possible for the pixel PX5 to display the $7^{th}$ gradation and for the pixel PX6 to display the $6^{th}$ gradation. That is, it is possible for the pixel PX5 and the pixel PX6 to display the gradation to be displayed.

Next, in FIG. 6, intermediate portion white writing is performed (step ST120). That is, out of the plurality of pixels 20 in the display unit 3, the pixels 20, which are set to a gradation lower than the gradation to be displayed by the second black writing (step ST100), are supplied with a positive polarity voltage pulse. In the example in FIG. 5, out of the plurality of pixels 20 in the display unit 3, the pixel PX8 and the pixel PX7, which are set to a gradation lower than the gradation to be displayed by the second black writing (step ST100), are supplied with a positive polarity voltage pulse Pw3 (refer to FIG. 11 described later). In addition, the voltage pulse Pw3 is an example of the "eighth voltage pulse" according to the invention. According to this, as shown in FIG. 9D, it is possible for the pixel PX8 to display the $4^{th}$ gradation and for the pixel PX7 to display the $5^{th}$ gradation. That is, it is possible for the pixel PX8 and the pixel PX7 to display the gradation to be displayed.

As described above, according to the embodiment, it is possible to display an image with 12 gradations as shown in FIG. 5 for example by performing the steps ST10 to ST120 described above with reference to FIG. 6.

In addition, according to the embodiment, since the initial gradation display (step ST21) is performed, when displaying an image including halftone, it is possible to display an image close to the image to be displayed at an initial stage.

Figure 10:
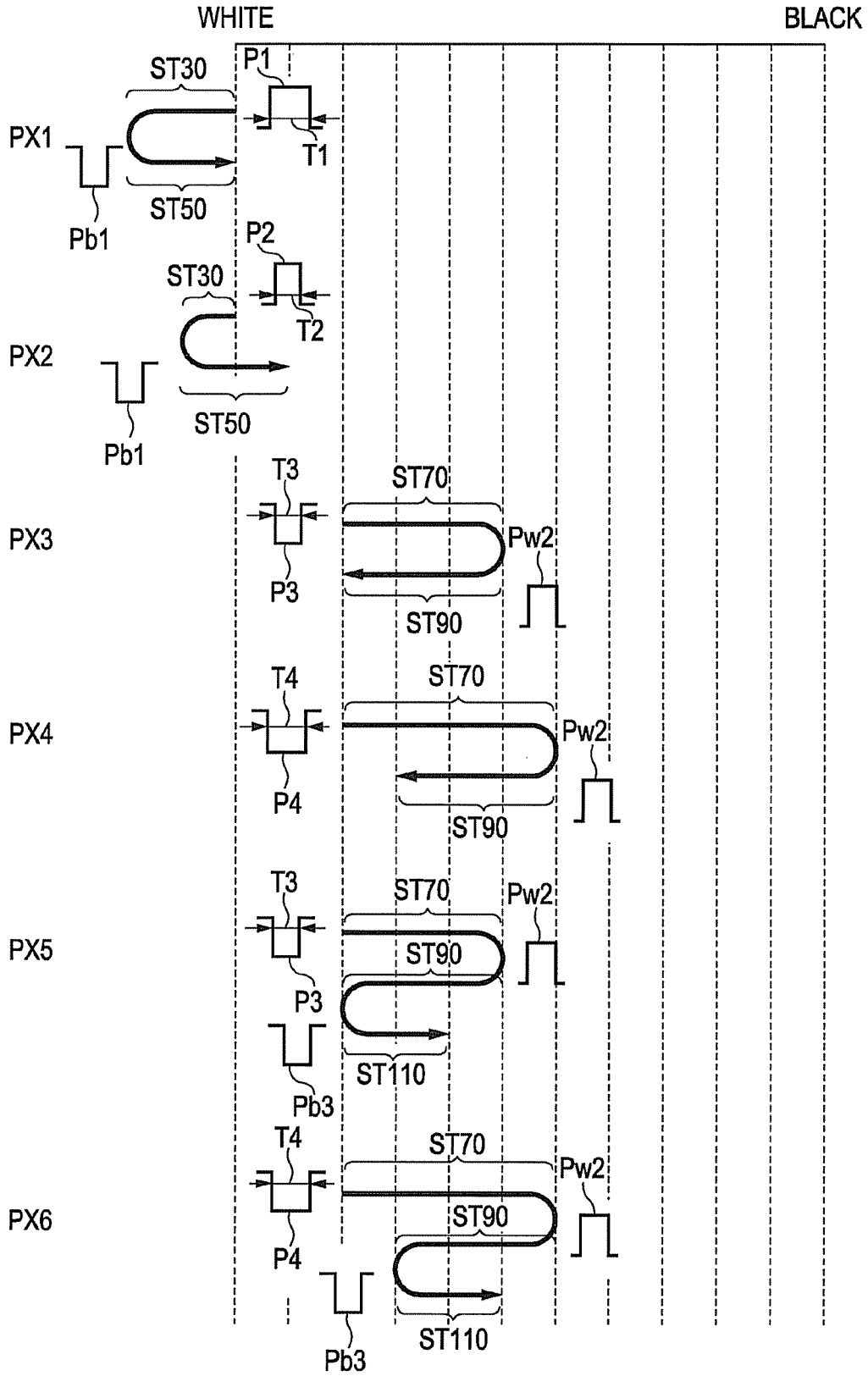
FIG. 10 is a conceptual diagram (1) for describing the driving method of the electrophoretic display device according to the first embodiment.
Figure 11:
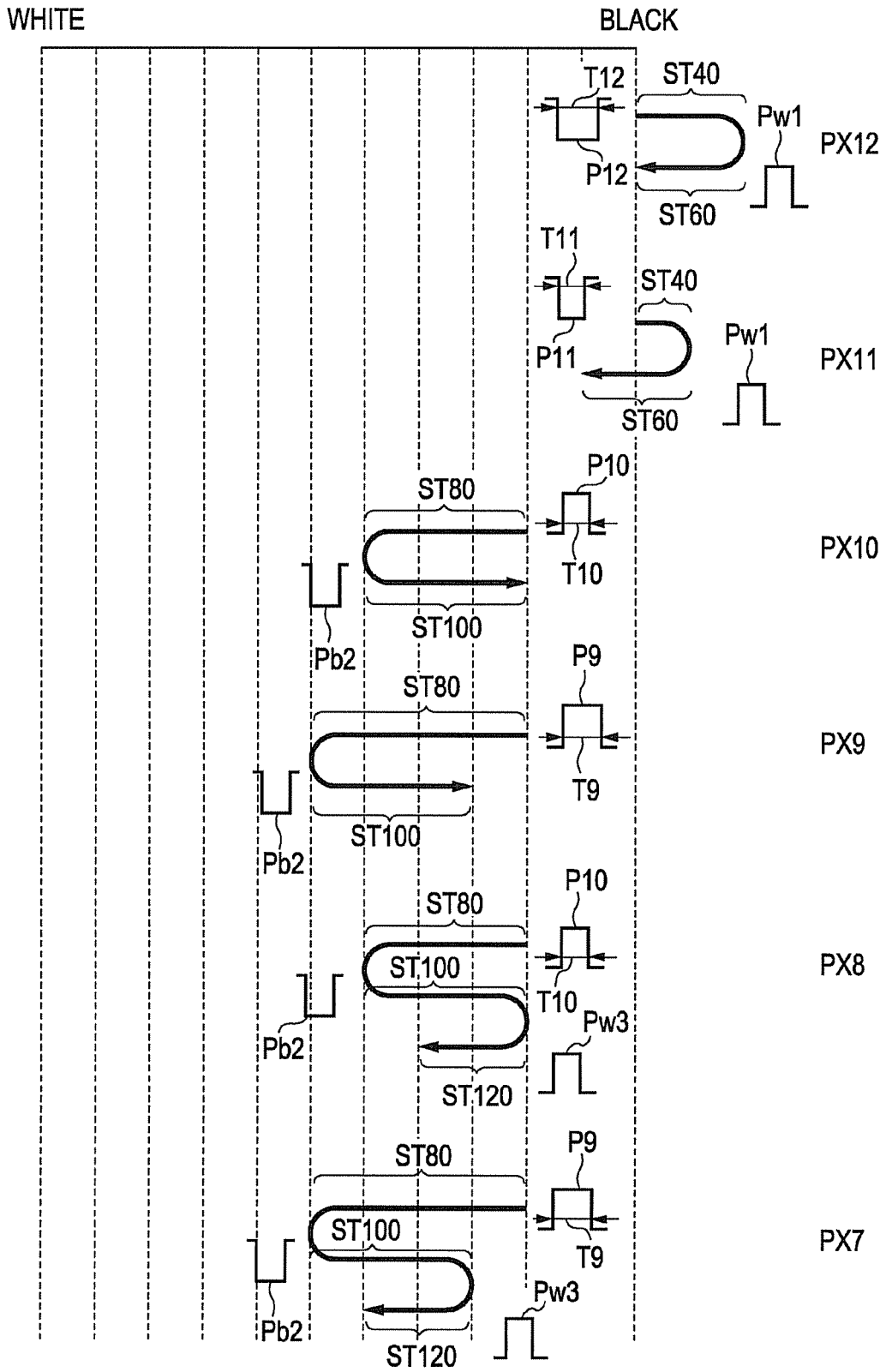
FIG. 11 is a conceptual diagram (2) for describing the driving method of the electrophoretic display device according to the first embodiment.

Next, description of the driving method of the electrophoretic display device according to the embodiment will be added with reference to FIGS. 10 and 11.

FIGS. 10 and 11 are conceptual diagrams for describing the driving method of the electrophoretic display device according to the embodiment. In addition, FIG. 10 conceptually shows the voltage pulses supplied in each step described above with reference to FIG. 6 and changes in the display states of the pixels when the voltage pulses are supplied, with regard to the pixels PX1 to PX5 shown in FIG. 5. FIG. 11 conceptually shows the voltage pulses supplied in each step described above with reference to FIG. 6 and changes in the display states of the pixels when the voltage pulses are supplied, with regard to the pixels PX6 to PX12 shown in FIG. 5. Additionally, the horizontal axis in FIGS. 10 and 11 shows the gradation which is the display state of the pixel (in other words, the density of the color displayed in the pixel).

In FIG. 10, according to the driving method of the embodiment, by supplying the positive polarity voltage pulse P1 to the pixel PX1 which displays white (that is, the $11^{th}$ gradation) in the excessive white preparation driving (step ST30), the pixel PX1 is set to a state (for example, the $15^{th}$ gradation state) where the white particles 82 are drawn more to the common electrode 22 side than the $11^{th}$ gradation, and by supplying the positive polarity voltage pulse P2 to the pixel PX2 which displays white (that is, the $11^{th}$ gradation) in the excessive white preparation driving (step ST30), the pixel PX2 is set to a state (for example, the $13^{th}$ gradation state) where the white particles 82 are drawn to the common electrode 22 side more than the $11^{th}$ gradation. Here, in the embodiment, the duration T1 of the voltage pulse P1 is set to be longer than the duration T2 of the voltage pulse P2, and the pixel PX1 enters a state where the white particles 82 are drawn to the common electrode 22 side more than the pixel PX2.

In this manner, the negative polarity voltage pulse Pb1 is supplied in the first black writing (step ST50) to the pixel PX1 and the pixel PX2 where the excessive white preparation driving (step ST30) has been performed. According to this, it is possible for the pixel PX1 to display the $11^{th}$ gradation (that is, white) and the pixel PX2 to display the $10^{th}$ gradation.

Here, in the embodiment, in particular, the negative polarity voltage pulse Pb1 is supplied in the first black writing (step ST50) to the pixels PX1 and PX2 which are in different display states from each other due to supplying of the positive polarity voltage pulses P1 and P2 in the excessive white preparation driving (step ST30). According to this, it is possible to make the display states of the pixels PX1 and PX2 closer to each other. In other words, it is possible to finely control the gradations of the pixels PX1 and PX2. That is, for example, it is possible to express a finer gradation in the pixels PX1 and PX2 compared to a case where a gradation displayed in the pixels PX1 and PX2 is controlled by not supplying a voltage pulse to the pixel PX1 which displays white (that is, the $11^{th}$ gradation) and supplying only a negative polarity voltage pulse to the pixel PX2 which displays white (that is, the $11^{th}$ gradation).

On the other hand, in FIG. 11, according to the driving method of the embodiment, by supplying the negative polarity voltage pulse P12 to the pixel PX12 which displays black (that is, the $0^{th}$ gradation) in the excessive black preparation driving (step ST40), the pixel PX12 is set to a state (for example, the $-4^{th}$ gradation state) where the black particles 83 are drawn to the common electrode 22 side more than the $0^{th}$ gradation, and by supplying the negative polarity voltage pulse P11 to the pixel PX11 which displays black (that is, the $0^{th}$ gradation) in the excessive black preparation driving (step ST40), the pixel PX11 is set to a state (for example, the $-2^{nd}$ gradation state) where the black particles 83 are drawn to the common electrode 22 side more than the $0^{th}$ gradation. Here, in the embodiment, the duration T12 of the voltage pulse P12 is set to be longer than the duration T11 of the voltage pulse P11, and the pixel PX12 enters a state where the black particles 83 are drawn to the common electrode 22 side more than the pixel PX11.

In this manner, the positive polarity voltage pulse Pw1 is supplied in the first white writing (step ST60) to the pixel PX12 and the pixel PX11 where the excessive black preparation driving (step ST40) has been performed. According to this, it is possible for the pixel PX12 to display the $0^{th}$ gradation (that is, black) and the pixel PX11 to display the $1^{st}$ gradation.

In FIG. 10, according to the driving method of the embodiment, by supplying the negative polarity voltage pulse P3 in the sequential black preparation driving (step ST70) to the pixel PX3 which is a gradation (for example, the $9^{th}$ gradation) between the $11^{th}$ gradation and the $6^{th}$ gradation due to the initial gradation display (step ST21), the pixel PX3 is set to a gradation (for example, the $6^{th}$ gradation) lower than the gradation to be displayed (that is, the $9^{th}$ gradation in the example in FIG. 5), and by supplying the negative polarity voltage pulse P4, which has the duration T4 longer than the duration T3 of the voltage pulse P3, in the sequential black preparation driving (step ST70) to the pixel PX4 which is a gradation (for example, the $9^{th}$ gradation) between the $11^{th}$ gradation and the $6^{th}$ gradation due to the initial gradation display (step ST21), the pixel PX4 is set to a gradation (for example, the $4^{th}$ gradation) lower than the gradation to be displayed (that is, the $8^{th}$ gradation in the example in FIG. 5).

In this manner, the positive polarity voltage pulse Pw2 is supplied in the second white writing (step ST90) to the pixel PX3 and the pixel PX4 where the sequential black preparation driving (step ST70) has been performed. According to this, it is possible for the pixel PX3 to display the $9^{th}$ gradation and the pixel PX4 to display the $8^{th}$ gradation.

Here, in the embodiment, in particular, the positive polarity voltage pulse Pw1 is supplied in the second white writing (step ST90) to the pixel PX3 and the pixel PX4 which are in different display states from each other due to supplying of the negative polarity voltage pulses P3 and P4 in the sequential black preparation driving (step ST70). According to this, it is possible to make the display states of the pixels PX3 and PX4 closer to each other. In other words, it is possible to finely control the gradations of the pixel PX3 and PX4. That is, for example, it is possible to express a finer gradation in the pixels PX3 and PX4 compared to a case where a gradation displayed in the pixels PX3 and PX4 is controlled by supplying only a negative polarity voltage pulse to the pixel PX3 which displays white (that is, the $11^{th}$ gradation) and supplying only a negative polarity voltage pulse, where the duration is different to the negative polarity voltage pulse supplied to the pixel PX3, to the pixel PX4 which displays white (that is, the $11^{th}$ gradation).

On the other hand, in FIG. 11, according to the driving method of the embodiment, by supplying the positive polarity voltage pulse P10 in the sequential white preparation driving (step ST80) to the pixel PX10 which is a gradation (for example, the $2^{nd}$ gradation) between the $0^{th}$ gradation and the $5^{th}$ gradation due to the initial gradation display (step ST21), the pixel PX10 is set to a gradation (for example, the $6^{th}$ gradation) higher than the gradation to be displayed (that is, the $2^{nd}$ gradation in the example in FIG. 5), and by supplying the positive polarity voltage pulse P9, which has the duration T9 longer than the duration T10 of the voltage pulse P10, in the sequential white preparation driving (step ST80) to the pixel PX9 which is a gradation (for example, the $2^{nd}$ gradation) between the $0^{th}$ gradation and the $5^{th}$ gradation due to the initial gradation display (step ST21), the pixel PX9 is set to a gradation (for example, the $4^{th}$ gradation) higher than the gradation to be displayed (that is, the $3^{rd}$ gradation in the example in FIG. 5).

In this manner, the negative polarity voltage pulse Pb2 is supplied in the second black writing (step ST100) to the pixel PX10 and the pixel PX9 where the sequential white preparation driving (step ST80) has been performed. According to this, it is possible for the pixel PX10 to display the $2^{nd}$ gradation and the pixel PX9 to display the $3^{rd}$ gradation.

In FIG. 10, according to the driving method of the embodiment, by supplying the negative polarity voltage pulse P3 in the sequential black preparation driving (step ST70) to the pixel PX5 which is a gradation (for example, the $9^{th}$ gradation) between the $11^{th}$ gradation and the $6^{th}$ gradation due to the initial gradation display (step ST21), the pixel PX5 is set to a gradation (for example, the $6^{th}$ gradation) lower than the gradation to be displayed (that is, the $7^{th}$ gradation in the example in FIG. 5), and by supplying the negative polarity voltage pulse P4, which has the duration T4 longer than the duration T3 of the voltage pulse P3, in the sequential black preparation driving (step ST70) to the pixel PX6 which is a gradation (for example, the $9^{th}$ gradation) between the $11^{th}$ gradation and the $6^{th}$ gradation due to the initial gradation display (step ST21), the pixel PX6 is set to a gradation (for example, the $4^{th}$ gradation) lower than the gradation to be displayed (that is, the $6^{th}$ gradation in the example in FIG. 5).

In this manner, after the positive polarity voltage pulse Pw2 is supplied in the second white writing (step ST90) to the pixel PX5 and PX6 where the sequential black preparation driving (step ST70) has been performed, the negative polarity voltage pulse Pb3 is further supplied in the intermediate portion black writing (step ST110). According to this, it is possible for the pixel PX5 to display the $7^{th}$ gradation and the pixel PX6 to display the $6^{th}$ gradation.

Here, in the embodiment, in particular, after the positive polarity voltage pulse Pw1 is supplied in the second white writing (step ST90) to the pixels PX5 and PX6 which are in different display states from each other due to supplying of the negative polarity voltage pulses P3 and P4 in the sequential black preparation driving (step ST70), the negative polarity voltage pulse Pb3 is further supplied in the intermediate portion black writing (step ST110). According to this, it is possible to make the display states of the pixels PX5 and PX6 closer to each other. In other words, it is possible to finely control the gradations of the pixels PX5 and PX6. That is, for example, it is possible to express a finer gradation in the pixels PX5 and PX6 compared to a case where a gradation displayed in the pixel PX5 and PX6 is controlled by supplying only a negative polarity voltage pulse to the pixel PX5 which displays white (that is, the $11^{th}$ gradation) and supplying only a negative polarity voltage pulse, where the duration is different from the negative polarity voltage pulse supplied to the pixel PX5, to the pixel PX6 which displays white (that is, the $11^{th}$ gradation).

On the other hand, in FIG. 11, according to the driving method of the embodiment, by supplying the positive polarity voltage pulse P10 in the sequential white preparation driving (step ST80) to the pixel PX8 which is a gradation (for example, the $2^{nd}$ gradation) between the $0^{th}$ gradation and the $5^{th}$ gradation due to the initial gradation display (step ST21), the pixel PX8 is set to a gradation (for example, the $5^{th}$ gradation) higher than the gradation to be displayed (that is, the $4^{th}$ gradation in the example in FIG. 5), and by supplying the positive polarity voltage pulse P9, which has the duration T9 longer than the duration T10 of the voltage pulse P10, in the sequential white preparation driving (step ST80) to the pixel PX7 which is a gradation (for example, the $2^{nd}$ gradation) between the $0^{th}$ gradation and the $5^{th}$ gradation due to the initial gradation display (step ST21), the pixel PX7 is set to a gradation (for example, the $7^{th}$ gradation) higher than the gradation to be displayed (that is, the $5^{th}$ gradation in the example in FIG. 5).

In this manner, after the negative polarity voltage pulse Pb2 is supplied in the second black writing (step ST100) to the pixel PX8 and PX7 where the sequential white preparation driving (step ST80) has been performed, the positive polarity voltage pulse Pw3 is further supplied in the intermediate portion white writing (step ST120). According to this, it is possible for the pixel PX8 to display the $4^{th}$ gradation and the pixel PX7 to display the $5^{th}$ gradation.

In the FIGS. 10 and 11, the display states of each of the pixels PX3 to PX6 (that is the $9^{th}$ gradation or the $8^{th}$ gradation) after the voltage pulse Pw2 is supplied to each of the pixels PX3 to PX6 in the step ST90 is a display state between white (that is, the $11^{th}$ gradation) and the display states of each of the pixels PX7 to PX10 (that is the $2^{nd}$ gradation or the $3^{rd}$ gradation) after the voltage pulse Pb2 is supplied to each of the pixels PX7 to PX10 in the step ST100. As such, after the step ST90 and the step ST100 are performed, it is possible to reliably display an image close to the image to be displayed. Accordingly, it is possible for a user to promptly visually recognize the content of the image to be displayed.

As described above, according to the driving method of the electrophoretic display device of the embodiment, it is possible to perform multitone display with high precision. In addition, when displaying an image including halftone, it is possible to display an image close to the image to be displayed at an initial stage.

The invention is not limited to the embodiment described above, and various modifications can be made within the spirit and the concept of the invention as stated in the scope of the claims, and an electrophoretic display device according to the modifications is included in the technical scope of the invention.

The entire disclosure of Japanese Patent Application No. 2010-050661, filed Mar. 8, 2010 is expressly incorporated by reference herein.

What is claimed is:

1. A driving method of an electrophoretic display device, which has a plurality of pixels where an electrophoretic layer is interposed between a first electrode and a second electrode, and when in a case when the potential of the first electrode is higher than the potential of the second electrode, a first polarity is set, and in a case when the potential of the first electrode is lower than the potential of the second electrode, a second polarity is set, as a display state of the pixel, a first display state is selected by supplying a voltage with the first polarity to the pixel and a second display state is selected by supplying a voltage with the second polarity to the pixel, and a halftone state between the first display state and the second display state is selected according to a period when the potential of the first electrode is higher than the potential of the second electrode, comprising:

supplying a first voltage pulse with one polarity of the first polarity or the second polarity to a first pixel in a third display state between the first display state and the second display state out of the plurality of pixels;

supplying a second voltage pulse with the other polarity of the first polarity or the second polarity to the first pixel;

supplying a third voltage pulse, which has the same polarity as the polarity of the first voltage pulse and has a duration different from a duration of the first voltage pulse, to a second pixel which is in the third display state out of the plurality of pixels; and supplying the second voltage pulse to the second pixel, wherein the second voltage pulse supplied to the first pixel and the second pixel is for a same duration, wherein a given pixel from among the plurality of pixel is driven to a final display state that is the first state, the second state, or the halftone state, when the final display state is the halftone state that is closer to the first state than the second state, the given pixel is driven to the first state before being driven to the final display state, and when the final display state is the halftone state that is closer to the second state than the first state, the given pixel is driven to the second state before being driven to the final display state.

2. The driving method of an electrophoretic display device according to claim 1, further comprising:

supplying a fourth voltage pulse with one polarity of the first and the second polarity to a third pixel in a fourth display state between the second display state and the third display state out of the plurality of pixels;

supplying a fifth voltage pulse with the other polarity of the first polarity or the second polarity to the third pixel;

supplying a sixth voltage pulse, which has the same polarity as the polarity of the fourth voltage pulse and has a duration different from a duration of the fourth voltage pulse, to a fourth pixel which is in the fourth display state out of the plurality of pixels; and supplying the fifth voltage pulse to the fourth pixel.

3. The driving method of an electrophoretic display device according to claim 1, wherein, the display state of the first pixel after the second voltage pulse is supplied to the first pixel is a display state between the display state of the third pixel after the fifth voltage pulse is supplied to the third pixel and the first display state.

4. The driving method of an electrophoretic display device according to claim 1, further comprising:

supplying a seventh voltage pulse with a polarity different from that of the second voltage pulse to the first and the second pixels.

5. The driving method of an electrophoretic display device according to claim 1, further comprising:

supplying an eighth voltage pulse with a polarity different from that of the fifth voltage pulse to the third and the fourth pixels.

6. A controller for controlling an electrophoretic display device, which has a plurality of pixels where an electrophoretic layer is interposed between a first electrode and a second electrode, and when in a case when the potential of the first electrode is higher than the potential of the second electrode, a first polarity is set, and in a case when the potential of the first electrode is lower than the potential of the second electrode, a second polarity is set, as a display state of the pixel, a first display state is selected by supplying a voltage with the first polarity to the pixel and a second display state is selected by supplying a voltage with the second polarity to the pixel, and a halftone state between the first display state and the second display state is selected according to a period when the potential of the first electrode is higher than the potential of the second electrode, the controller executing a driving method comprising:

supplying a first voltage pulse with one polarity of the first polarity or the second polarity to a first pixel in a third display state between the first display state and the second display state out of the plurality of pixels;

supplying a second voltage pulse with the other polarity of the first polarity or the second polarity to the first pixel;

supplying a third voltage pulse, which has the same polarity as the polarity of the first voltage pulse and has a duration different from a duration of the first voltage pulse, to a second pixel which is in the third display state out of the plurality of pixels; and supplying the second voltage pulse to the second pixel, wherein the second voltage pulse supplied to the first pixel and the second pixel is for a same duration, wherein a given pixel from among the plurality of pixel is driven to a final display state that is the first state, the second state, or the halftone state, when the final display state is the halftone state that is closer to the first state than the second state, the given pixel is driven to the first state before being driven to the final display state, and when the final display state is the halftone state that is closer to the second state than the first state, the given pixel is driven to the second state before being driven to the final display state.

7. The controller according to claim 6, the driving method further comprising:

supplying a fourth voltage pulse with one polarity of the first and the second polarity to a third pixel in a fourth display state between the second display state and the third display state out of the plurality of pixels;

supplying a fifth voltage pulse with the other polarity of the first polarity or the second polarity to the third pixel;

supplying a sixth voltage pulse, which has the same polarity as the polarity of the fourth voltage pulse and has a duration different from a duration of the fourth voltage pulse, to a fourth pixel which is in the fourth display state out of the plurality of pixels; and supplying the fifth voltage pulse to the fourth pixel.

8. The controller according to claim 6, wherein, the display state of the first pixel after the second voltage pulse is supplied to the first pixel is a display state between the display state of the third pixel after the fifth voltage pulse is supplied to the third pixel and the first display state.

9. The controller according to claim 6, the driving method further comprising:

supplying a seventh voltage pulse with a polarity different from that of the second voltage pulse to the first and the second pixels.

10. The controller according to claim 6, the driving method further comprising:

supplying an eighth voltage pulse with a polarity different from that of the fifth voltage pulse to the third and the fourth pixels.

11. The driving method of an electrophoretic display device according to claim 1 wherein after the second voltage pulse to the first pixel and the second voltage pulse to the second pixel, the first pixel and the second pixel have different display states.

12. The driving method of an electrophoretic display device according to claim 1 wherein the second voltage pulse is less than or equal to the first voltage pulse and to the third voltage pulse.

13. A driving method of an electrophoretic display device, which has a plurality of pixels where an electrophoretic layer is interposed between a first electrode and a second electrode, and when in a case when the potential of the first electrode is higher than the potential of the second electrode, a first polarity is set, and in a case when the potential of the first electrode is lower than the potential of the second electrode, a second polarity is set, as a display state of the pixel, a first display state is selected by supplying a voltage with the first polarity to the pixel and a second display state is selected by supplying a voltage with the second polarity to the pixel, and a halftone state between the first display state and the second display state is selected according to a period when the potential of the first electrode is higher than the potential of the second electrode, comprising:

supplying a first voltage pulse with one polarity of the first polarity or the second polarity to a first pixel in a third display state between the first display state and the second display state out of the plurality of pixels;

supplying a second voltage pulse with the other polarity of the first polarity or the second polarity to the first pixel;

supplying a third voltage pulse, which has the same polarity as the polarity of the first voltage pulse and has a duration different from a duration of the first voltage pulse, to a second pixel which is in the third display state out of the plurality of pixels; and supplying the second voltage pulse to the second pixel, wherein the second voltage pulse supplied to the first pixel and the second pixel is for a same duration, wherein a given pixel from among the plurality of pixel is driven to a final display state that is either the first state, the second state, or the halftone state between the first state and the second state, when the final display state is the halftone state that is closer to the first state and is greater than a first predetermined halftone state, the given pixel is driven to the first state before being driven to the final display state, and when the final display state is the halftone state that is closer to the second state and is less than a second predetermined halftone state, the given pixel is driven to the second state before being driven to the final display state.

14. The driving method of an electrophoretic display device according to claim 4 wherein the seventh voltage pulse is less than the second voltage pulse.

15. The controller according to claim 6 wherein after the second voltage pulse to the first pixel and the second voltage pulse to the second pixel, the first pixel and the second pixel have different display states.

16. The controller according to claim 6 wherein the second voltage pulse is less than or equal to the first voltage pulse and to the third voltage pulse.

17. A controller for controlling an electrophoretic display device, which has a plurality of pixels where an electrophoretic layer is interposed between a first electrode and a second electrode, and when in a case when the potential of the first electrode is higher than the potential of the second electrode, a first polarity is set, and in a case when the potential of the first electrode is lower than the potential of the second electrode, a second polarity is set, as a display state of the pixel, a first display state is selected by supplying a voltage with the first polarity to the pixel and a second display state is selected by supplying a voltage with the second polarity to the pixel, and a halftone state between the first display state and the second display state is selected according to a period when the potential of the first electrode is higher than the potential of the second electrode, the controller executing a driving method comprising:

supplying a first voltage pulse with one polarity of the first polarity or the second polarity to a first pixel in a third display state between the first display state and the second display state out of the plurality of pixels;

supplying a second voltage pulse with the other polarity of the first polarity or the second polarity to the first pixel;

supplying a third voltage pulse, which has the same polarity as the polarity of the first voltage pulse and has a duration different from a duration of the first voltage pulse, to a second pixel which is in the third display state out of the plurality of pixels; and supplying the second voltage pulse to the second pixel, wherein the second voltage pulse supplied to the first pixel and the second pixel is for a same duration, wherein a given pixel from among the plurality of pixel is driven to a final display state that is either the first state, the second state, or the halftone state between the first state and the second state, when the final display state is the halftone state that is closer to the first state and is greater than a first predetermined halftone state, the given pixel is driven to the first state before being driven to the final display state, and when the final display state is the halftone state that is closer to the second state and is less than a second predetermined halftone state, the given pixel is driven to the second state before being driven to the final display state.

18. The controller according to claim 9 wherein the seventh voltage pulse is less than the second voltage pulse.

* * * * *